US007871309B2

(12) United States Patent
Ogawa et al.

(10) Patent No.: US 7,871,309 B2
(45) Date of Patent: Jan. 18, 2011

(54) POLISHING PAD

(75) Inventors: Kazuyuki Ogawa, Osaka (JP); Tetsuo Shimomura, Osaka (JP); Atsushi Kazuno, Osaka (JP); Yoshiyuki Nakai, Osaka (JP); Masahiro Watanabe, Osaka (JP); Takatoshi Yamada, Osaka (JP); Masahiko Nakamori, Osaka (JP)

(73) Assignee: Toyo Tire & Rubber Co., Ltd., Osaka (JP)

( * ) Notice: Subject to any disclaimer, the term of this patent is extended or adjusted under 35 U.S.C. 154(b) by 799 days.

(21) Appl. No.: 11/720,964

(22) PCT Filed: Dec. 8, 2005

(86) PCT No.: PCT/JP2005/022550

§ 371 (c)(1),
(2), (4) Date: Jun. 6, 2007

(87) PCT Pub. No.: WO2006/062158

PCT Pub. Date: Jun. 15, 2006

(65) Prior Publication Data

US 2009/0253353 A1 Oct. 8, 2009

(30) Foreign Application Priority Data

| | | |
|---|---|---|
| Dec. 10, 2004 | (JP) | 2004-358595 |
| Jan. 6, 2005 | (JP) | 2005-001628 |
| Jan. 6, 2005 | (JP) | 2005-001635 |
| Jan. 6, 2005 | (JP) | 2005-001668 |
| Feb. 21, 2005 | (JP) | 2005-044027 |

(51) Int. Cl.
*B24B 1/00* (2006.01)
*B24D 11/00* (2006.01)

(52) U.S. Cl. ..... 451/41; 51/297; 451/59; 451/527; 451/533

(58) Field of Classification Search ..... 51/293, 51/297, 298; 451/6, 287, 288, 290, 527, 451/533, 534, 41, 59, 63
See application file for complete search history.

(56) References Cited

U.S. PATENT DOCUMENTS 5,069,002 A 12/1991 Sandhu et al.

(Continued)

FOREIGN PATENT DOCUMENTS

JP 55-106769 8/1980

(Continued)

OTHER PUBLICATIONS

Office Action issued by the Japanese Patent Office on Nov. 5, 2010 for the counterpart Japanese Patent Application No. 2004-358595.

(Continued)

*Primary Examiner*—Timothy V Eley
(74) *Attorney, Agent, or Firm*—Knobbe Martens Olson & Bear LLP

(57) ABSTRACT

It is an object of the invention to provide a polishing pad capable of high precision optical detection of an endpoint during polishing in progress and prevention of slurry leakage from between a polishing region and a light-transmitting region during the use thereof even after the polishing pad has been used for a long period. It is a second object of the invention to provide a polishing pad capable of suppression of deterioration of polishing characteristics (such as in-plane uniformity) and generation of scratches due to a difference in behavior of a polishing region and a light-transmitting region during polishing. It is a third object of the invention to provide a polishing pad having a polishing region and a light-transmitting region with a concentration of a specific metal equal to or lower than a specific value (threshold value).

29 Claims, 6 Drawing Sheets

U.S. PATENT DOCUMENTS

| | | | | |
|---|---|---|---|---|
| 5,081,421 | A | 1/1992 | Miller et al. | |
| 5,196,353 | A | 3/1993 | Sandhu et al. | |
| 5,559,428 | A | 9/1996 | Li et al. | |
| 6,280,290 | B1 * | 8/2001 | Birang et al. | 451/6 |
| 6,458,014 | B1 * | 10/2002 | Ihsikawa et al. | 451/6 |
| 7,264,536 | B2 * | 9/2007 | Wiswesser et al. | 451/6 |
| 7,547,243 | B2 * | 6/2009 | Wiswesser et al. | 451/6 |
| 2005/0064802 | A1 * | 3/2005 | Wiswesser et al. | 451/285 |
| 2006/0037699 | A1 | 2/2006 | Nakamori et al. | |

FOREIGN PATENT DOCUMENTS

| | | | |
|---|---|---|---|
| JP | 7-135190 | | 5/1995 |
| JP | 9-7985 | | 1/1997 |
| JP | 9-36072 | | 2/1997 |
| JP | 10-83977 | | 3/1998 |
| JP | 11-512977 | T | 11/1999 |
| JP | 2000-343411 | | 12/2000 |
| JP | 2001-291686 | | 10/2001 |
| JP | 2001-308045 | | 11/2001 |
| JP | 2002-324769 | | 11/2002 |
| JP | 2002-327770 | | 11/2002 |
| JP | 2003-19658 | | 1/2003 |
| JP | 2003-48151 | | 2/2003 |
| JP | 2003-68686 | | 3/2003 |
| JP | 2003-510826 | T | 3/2003 |
| JP | 2004-106177 | | 4/2004 |
| JP | 3547737 | | 7/2004 |
| JP | 2004-256738 | | 9/2004 |
| JP | 2004-327779 | | 11/2004 |
| JP | 2004-343090 | | 12/2004 |
| KR | 10-2004-25989 | A | 3/2004 |
| WO | WO 01/15860 | A1 | 3/2001 |
| WO | WO 2004/049417 | A1 | 6/2004 |

* cited by examiner

| contained Fe concentration (ppm) | device yield (%) |
|---|---|
| 0.05 | 96 |
| 0.10 | 95 |
| 0.30 | 83 |
| 0.60 | 40 |
| 1.00 | 0 |

| contained Ni concentration (ppm) | device yield (%) |
|---|---|
| 0.03 | 90 |
| 0.18 | 90 |
| 0.50 | 90 |
| 1.00 | 82 |
| 1.50 | 57 |
| 5.00 | 8 |

| contained Cu concentration (ppm) | device yield (%) |
|---|---|
| 0.03 | 95 |
| 0.07 | 95 |
| 0.33 | 95 |
| 0.50 | 81 |
| 0.67 | 45 |
| 1.00 | 0 |

| contained Zn concentration (ppm) | device yield (%) |
|---|---|
| 0.02 | 90 |
| 0.06 | 90 |
| 0.10 | 83 |
| 0.17 | 70 |
| 0.33 | 47 |
| 1.00 | 5 |

| contained Al concentration (ppm) | device yield (%) |
|---|---|
| 0.01 | 100 |
| 0.06 | 100 |
| 0.42 | 100 |
| 1.20 | 82 |
| 2.40 | 40 |
| 3.60 | 3 |

| contained Mg concentration (ppm) | device yield (%) |
|---|---|
| 0.02 | 87 |
| 0.06 | 87 |
| 0.07 | 87 |
| 0.10 | 87 |
| 0.34 | 87 |
| 0.40 | 85 |
| 0.60 | 84 |
| 1.60 | 80 |

| contained Cr concentration (ppm) | device yield (%) |
|---|---|
| 0.02 | 84 |
| 0.10 | 84 |
| 0.40 | 84 |
| 1.00 | 84 |

POLISHING PAD

This application is the U.S. National Phase under 35 U.S.C. §371 of International Application PCT/JP2005/022550, filed Dec. 8, 2005, which claims priority to Japanese Patent Application No. 2004-358595, filed Dec. 10, 2004, Japanese Patent Application No. 2005-001628, filed Jan. 6, 2005, Japanese Patent Application No. 2005-001635, filed Jan. 6, 2005, Japanese Patent Application No. 2005-001668, filed Jan. 6, 2005, and Japanese Patent Application No. 2005-044027, filed Feb. 21, 2005. The International Application was published under PCT Article 21(2) in a language other than English.

TECHNICAL FIELD

The present invention relates to a polishing pad used in planarizing an uneven surface of a wafer by chemical mechanical polishing (CMP) and in particular to a polishing pad having a window for sensing a polished state etc. by an optical means, as well as a method of producing a semiconductor device by the polishing pad.

BACKGROUND ART

Production of a semiconductor device involves a step of forming an electroconductive film on the surface of a wafer to form a wiring layer by photolithography, etching etc., a step of forming an interlaminar insulating film on the wiring layer, etc., and an uneven surface made of an electroconductive material such as metal and an insulating material is generated on the surface of a wafer by these steps. In recent years, processing for fine wiring and multilayer wiring is advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique wherein while the surface of a wafer to be polished is pressed against a polishing surface of a polishing pad, the surface of the wafer is polished with an abrasive in the form of slurry having abrasive grains dispersed therein (hereinafter, referred to as slurry).

As shown in FIG. 1, a polishing apparatus used generally in CMP is provided for example with a polishing platen 2 for supporting a polishing pad 1, a supporting stand (polishing head) 5 for supporting a polished material (wafer) 4, a backing material for uniformly pressurizing a wafer, and a mechanism of feeding an abrasive. The polishing pad 1 is fitted with the polishing platen 2 for example via a double-coated tape. The polishing platen 2 and the supporting stand 5 are provided with rotating shafts 6 and 7 respectively and are arranged such that the polishing pad 1 and the polished material 4, both of which are supported by them, are opposed to each other. The supporting stand 5 is provided with a pressurizing mechanism for pushing the polished material 4 against the polishing pad 1.

When such CMP is conducted, there is a problem of judging the planarity of wafer surface. That is, the point in time when desired surface properties or planar state are reached should be detected. With respect to the thickness of an oxide film, polishing speed etc., the polishing treatment of a test wafer has been conducted by periodically treating the wafer, and after the results are confirmed, a wafer serving as a product is subjected to polishing treatment.

In this method, however, the treatment time of a test wafer and the cost for the treatment are wasteful, and a test wafer and a product wafer not subjected to processing are different in polishing results due to a loading effect unique to CMP, and accurate prediction of processing results is difficult without actual processing of the product wafer.

Accordingly, there is need in recent years for a method capable of in situ detection of the point in time when desired surface properties and thickness are attained at the time of CMP processing, in order to solve the problem described above. In such detection, various methods are used. The detection means proposed at present include:

(1) a method of detecting torque wherein the coefficient of friction between a wafer and a pad is detected as a change of the rotational torque of a wafer-keeping head and a platen (U.S. Pat. No. 5,069,002), (2) an electrostatic capacity method of detecting the thickness of an insulating film remaining on a wafer (U.S. Pat. No. 5,081,421), (3) an optical method wherein a film thickness monitoring mechanism by a laser light is integrated in a rotating platen (JP-A 9-7985 and JP-A 9-36072), (4) a vibrational analysis method of analyzing a frequency spectrum obtained from a vibration or acceleration sensor attached to a head or spindle, (5) a detection method by applying a built-in differential transformer in a head, (6) a method wherein the heat of friction between a wafer and a polishing pad and the heat of reaction between slurry and a material to be polished are measured by an infrared radiation thermometer (U.S. Pat. No. 5,196,353), (7) a method of measuring the thickness of a polished material by measuring the transmission time of supersonic waves (JP-A 55-106769 and JP-A 7-135190), and (8) a method of measuring the sheet resistance of a metallic film on the surface of a wafer (U.S. Pat. No. 5,559,428). At present, the method (1) is often used, but the method (3) comes to be used mainly from the viewpoint of measurement accuracy and spatial resolution in non-constant measurement.

The optical detection means as the method (3) is specifically a method of detecting the endpoint of polishing by irradiating a wafer via a polishing pad through a window (light-transmitting region) with a light beam, and monitoring an interference signal generated by reflection of the light beam.

At present, a He—Ne laser light having a wavelength light in the vicinity of 600 nm and a white light using a halogen lamp having a wavelength light in 380 to 800 nm is generally used.

In such method, the endpoint is determined by knowing an approximate depth of surface unevenness by monitoring a change in the thickness of a surface layer of a wafer. When such change in thickness becomes equal to the thickness of unevenness, the CMP process is finished. As a method of detecting the endpoint of polishing by such optical means and a polishing pad used in the method, various methods and polishing pads have been proposed.

A polishing pad having, as least a part thereof, a solid and uniform transparent polymer sheet passing a light of wavelengths of 190 to 3500 nm therethrough is disclosed (Japanese Patent Application National Publication (Laid-Open) No. 11-512977). Further, a polishing pad having a stepped transparent plug inserted into it is disclosed (JP-A 9-7985). A polishing pad having a transparent plug on the same surface as a polishing surface is disclosed (JP-A 10-83977). Further, a polishing pad wherein a light-permeable member comprises a water-insoluble matrix material and water-soluble particles dispersed in the water-insoluble matrix material and the light transmittance thereof at 400 to 800 nm is 0.1% or more is disclosed (JP-A 2002-324769 and JP-A 2002-324770). It is disclosed that a window for endpoint detection is used in any of the polishing pad.

Besides, a proposal is also offered for preventing a slurry from leaking out an interface (joint line) between a polishing region and a light-transmitting region (JP-A Nos. 2001-291686 and 2003-510826). Even in a case where each of the proposed transparent leakage preventive sheets is provided, however, the slurry is leaked out from the interface therebetween up to the lower part of a polishing layer and accumulated on the leakage preventive sheet to thereby cause a problem in optical detection of an endpoint.

A wire width of an integrated circuit will be hereinafter expected so as to be increasingly narrower in the future tendency of higher integration and leveled-up supper compactness in a semiconductor fabrication and in such a situation, a necessity arises for a high precision optical detection of an endpoint, whereas a conventional detection window for an endpoint has had a problem of the slurry leakage insufficiently solved. A conventional detection window for an endpoint have not reached a detection precision at a sufficiently satisfactory level because of limitation on usable materials. In a case where a polishing pad having a light-transmitting region was employed, problems arose that polishing characteristics (such as in-plane uniformity) were deteriorated or that scratches occurred on a wafer.

On the other hand, in performing a CMP process, a problem has arisen that a wafer is metal contaminated. In the CMP process, a wafer is polished while a slurry is caused to flow over a polishing pad and in this situation, metals contained in the slurry or the polishing pad remain on a polished wafer. Such metal contamination on a wafer results in reduction in reliability and generation of a leakage current in an insulating film and abnormality in a formed film, which exerts a great adverse influence on a semiconductor device to in turn, decreases a production yield. Especially, in the current semiconductor fabrication, when a shallow trench isolation (STI) is adopted wherein isolation on a semiconductor substrate has been a technical main stream, metal contamination in an oxide film after polishing is a very severe problem. In the STI, predetermined shallow trenches are formed on a silicon wafer and the trenches are buried with $SiO_2$ film deposited therein. Thereafter, the surface is polished to fabricate regions isolated by the oxide film. Elements (such as transistors) are fabricated in the isolated regions; therefore, the metal contamination on the wafer surface after polishing reduces performances and lowers reliability of all the elements. Therefore, in the current technology, a wafer cleaning step has been adopted after CMP in order to decrease metal contamination on a wafer.

Cleaning a wafer, however, has many of demerits such as oxidation of wiring; therefore a desire has been piled up for less of contamination from a slurry or a polishing pad. Especially, a metal ion such as a Fe ion is hard to be removed by cleaning and easy to remain on a wafer.

Therefore, in order to solve the above problem, a proposal has been lately offered of a polishing sheet having a polishing layer of high molecular weight polyethylene based resin with a metal impurity concentration of 100 ppm or less (JP-A No. 2000-343411). Besides, another proposal has been offered of a polishing cloth for a semiconductor wafer with a zinc content of 200 ppm or less (WO 01/15860 A1)

At the above metal impurity concentration, metal contamination of a wafer cannot be sufficiently prevented, which imposes a burden in cleaning of a wafer after CMP, having lead to difficulty improving a product yield of a device.

Still another proposal has been offered of a polishing pad using an organic intermolecular crosslinking agent in which a metal atom is reduced to the lowest possible level (JP-A No. 2001-308045)

However, a concrete metal concentration contained in a polishing pad has not clearly described in the last proposal. In addition, the polishing pad is molded in a metal mold in manufacture; therefore, the polishing pad cannot decrease at all a metal contamination on a surface of a wafer.

SUMMARY OF THE INVENTION

The invention has been made in order to solve the above problem and it is an object of the invention to provide a polishing pad capable of high precision optical detection of an endpoint during polishing in progress and prevention of slurry leakage from between a polishing region and a light-transmitting region during the use thereof even after the polishing pad has been used for a long period. It is a second object of the invention to provide a polishing pad capable of suppression of deterioration of polishing characteristics (such as in-plane uniformity) and generation of scratches due to a difference in behavior of a polishing region and a light-transmitting region during polishing. It is a third object of the invention to provide a polishing pad having a polishing region and a light-transmitting region with a concentration of a specific metal equal to or lower than a specific value (threshold value). It is a fourth object of the invention to provide a method for fabricating a semiconductor device using the polishing pad.

The inventor has conducted serious studies in light of the current state of the technology as described above with the result of a discovery that the above problem can be solved with the following polishing pads.

First Invention

The invention relates to a polishing pad having a polishing region and a light-transmitting region, wherein a water permeation preventive layer is provided on one surfaces of the polishing region and the light-transmitting region and the light-transmitting region and the water permeation preventive layer are made of the same material integrally in a single piece.

A conventional polishing pad having a polishing region and a light-transmitting region has had a structure as shown in FIG. 2. In CMP, a polishing pad and an object to be polished such as a wafer are rotated about its center or revolved about a center outside thereof and polishing is performed by friction under pressure. Since during polishing, various kinds of forces (especially in a horizontal direction) act on the light-transmitting region 9 and a polishing region 8, a peeling state always arises at the interface between the both regions. A conventional polishing pad 1 is easy to be peeled off at the interface between the both members and therefore, it is thought that a clearance occurs to leak a slurry. The slurry leakage is thought to cause optical problems such as a clouding on a light detector, thereby reducing a detection precision of an endpoint or disabling the detection thereof.

In a polishing pad of the invention, if the light-transmitting region and the polishing region are affected by a force to peel them during polishing and a slurry is leaked from between the interface between the both members, no slurry is leaked in the neighborhood of a light detector since a water permeation preventive layer is provided as the lower layer. Since the water permeation preventive layer is formed with the same material as the light-transmitting region and has a light transmittability, no difficulty occurs detecting an endpoint optically. Since the light-transmitting region and the water permeation preventive layer are formed with the same material integrally in a single piece, light scattering due to difference in refractive index can be suppressed, thereby enabling high precision optical detection of an endpoint to be achieved. The term, formed integrally in a single piece, means that no different material exists between the light-transmitting region and the water permeation preventive layer.

In the invention, it is preferably that no interface exists between the light-transmitting region and the wafer permeation preventive layer. In this case, scattering of light due to difference in refractive index can be further suppressed, thereby enabling high precision optical detection of an endpoint to be achieved.

In the invention, the water permeation preventive layer has preferably a cushioning property. Since the water permeation preventive region has a cushioning property, a separate step of providing a cushion layer can be omitted.

A material of which the light-transmitting region and the water permeation preventive layer are made is preferably a non-foam. Since a non-foam can suppress scattering of light, a correct reflectance can be detected, thereby enabling an optical detection precision of an endpoint in polishing to be raised.

A polishing side surface of the light-transmitting region has preferably no depression and protrusion structure holding and renewing a polishing liquid. The term, a depression and protrusion structure, means a groove or a hole formed on a member surface by cutting or the like. If macroscopic surface depressions and protrusions exist on a polishing side surface of the light-transmitting region, a slurry containing additives such as abrasive grains is collected in depressions and scattering and absorption of light occur, which tends to affect detection precision. A surface of the water permeation protective layer has also preferably no macroscopic surface depressions and protrusions. If macroscopic surface depressions and protrusions exist, scattering of light is easy to occur, leading to an adverse possibility to exert an influence on detection precision.

In the invention, the material for forming the polishing region is preferably fine-cell foam.

In the invention, the surface of the polishing region at the polishing side has preferably a depression and protrusion structure holding and renewing a polishing liquid.

Also, the average cell diameter of the fine-cell foam is preferably 70 μm or less, more preferably 50 μm or less. When the average cell diameter is 70 μm or less, planarity is improved.

The specific gravity of the fine-cell foam is preferably 0.5 to 1.0, more preferably 0.7 to 0.9. When the specific gravity is less than 0.5, the strength of the surface of the polishing region is lowered to reduce the planarity of an object of polishing, while when the specific gravity is higher than 1.0, the number of fine cells on the surface of the polishing region is decreased, and planarity is good, but the rate of polishing tends to be decreased.

The hardness of the fine-cell foam is preferably 35 to 65°, more preferably 40 to 60°, in terms of Asker D hardness. When the Asker D hardness is less than 35°, the planarity of an object of polishing is decreased, while when the planarity is greater than 60°, the planarity is good, but the uniformity of an object of polishing tends to be decreased.

The compressibility of the fine-cell foam is preferably 0.5 to 5.0%, more preferably 0.5 to 3.0%. When the compressibility is in this range, both planarity and uniformity can be satisfied. The compressibility is a value calculated from the following equation:

$$\text{Compressibility}(\%)=\{(T1-T2)/T1\}\times 100$$

T1: the thickness of fine-cell foam after the fine-cell foam in a non-loaded state is loaded with a stress of 30 kPa (300 g/cm$^2$) for 60 seconds.

T2: the thickness of the fine-cell foam after the fine-cell foam allowed to be in the T1 state is loaded with a stress of 180 kPa (1800 g/cm$^2$) for 60 seconds.

The compression recovery of the fine-cell foam is preferably 50 to 100%, more preferably 60 to 100%. When the compression recovery is less than 50%, the thickness of the polishing region is significantly changed as loading during polishing is repeatedly applied onto the polishing region, and the stability of polishing characteristics tends to be lowered. The compression recovery is a value calculated from the following equation:

$$\text{Compression recovery}(\%)=[(T3-T2)/(T1-T2)]\times 100$$

T1: the thickness of fine-cell foam after the fine-cell foam in a non-loaded state is loaded with a stress of 30 kPa (300 g/cm$^2$) for 60 seconds.

T2: the thickness of the fine-cell foam after the fine-cell foam after allowed to be in the T1 state is loaded with a stress of 180 kPa (1800 g/cm$^2$) for 60 seconds.

T3: the thickness of the fine-cell foam after the fine-cell foam after allowed to be in the T2 state is kept without loading for 60 seconds and then loaded with a stress of 30 kPa (300 g/cm$^2$) for 60 seconds.

The storage elastic modulus of the fine-cell foam at 40° C. at 1 Hz is preferably 150 MPa or more, more preferably 250 MPa or more. When the storage elastic modulus is less than 150 MPa, the strength of the surface of the polishing region is lowered and the planarity of an object of polishing tends to be reduced. The storage elastic modulus refers to the elastic modulus determined by measuring the fine-cell foam by applying sinusoidal wave vibration with a tensile testing jig in a dynamic viscoelastometer.

The invention relates to a method for manufacturing the polishing pad including: a step of forming an aperture for providing the light-transmitting region in the polishing region; a step of casting a material into a mold having shapes of the light-transmitting region and the water permeation preventive layer and curing the material to thereby form a transparent member into which the light-transmitting region and the water permeation preventive layer are made as a single piece; and a step of fittingly inserting the light-transmitting region into the aperture in the polishing region to thereby laminate the polishing region and the transparent member.

The invention relates to a method for manufacturing the polishing pad including: a step of forming an aperture for providing the light-transmitting region in the polishing region; and a step of casting a material into a space section having shapes of the light-transmitting region and the water permeation preventive layer and curing the material to thereby form a transparent member into which the light-transmitting region and the water permeation preventive layer are made integrally as a single piece.

Second Invention

The invention relates to a polishing pad, in which a polishing layer having a polishing region and an aperture A for providing a light-transmitting region therein and a cushion layer having an aperture B smaller than the light-transmitting region are laminated one on the other so that the apertures A and B are superimposed one on the other, the light-transmitting region is provided on the aperture B and in the aperture A and a water non-permeable elastic member having a hardness lower than the polishing region and the light-transmitting region is provided in an annular groove existing between the aperture A and the light-transmitting region.

A conventional polishing pad into which a light-transmitting region is fittingly inserted in an aperture of the polishing region so that the narrowest clearance occurs to prevent slurry leakage. However, a slurry flows on a surface of the polishing pad during polishing and the polishing region and a light-transmitting region are, it is thought, swollen by the action of a solvent in the slurry. Swelling of the polishing region and the light-transmitting region causes a strain in the light-transmitting region and the inserted portion thereof in the polishing pad, leading to protrusion of the light-transmitting region and deformation of the polishing pad. As a result, polishing characteristics such as in-plane uniformity are thought to be degraded.

In CMP, the polishing pad and an object to be polished such as a wafer are rotated about its center or revolved about a center outside thereof and polishing is effected by friction under pressure. Since various kinds of forces (especially, in a horizontal direction) act in the light-transmitting region and the polishing region during polishing, a peeling state always arises at the interface between both members. A conventional polishing pad is easy to be peeled off at the interface between the both members, it is thought, to create a clearance at the interface and to cause slurry leakage there. The slurry leakage causes optical problems such as clouding on an optical endpoint detecting section, which is thought to reduce detection precision of an endpoint or disable detection of an endpoint to be achieved.

A polishing pad of the invention has a water non-permeable elastic member less in hardness than the polishing region or the light-transmitting region in an annular groove existing between the aperture A and the light-transmitting region, since the water non-permeable elastic member has elasticity and a sufficiently low hardness, a strain or a dimensional change occurring in the light-transmitting region and the inserted portion thereof in the polishing pad can be absorbed therein. Hence, polishing is performed without protrusion or deformation of the light-transmitting region and deformation of the polishing pad during polishing, and furthermore, degradation of polishing characteristics such as in-plane uniformity can be suppressed.

The water non-permeable elastic member seals contact portions between the polishing region, the light-transmitting region and a cushion layer perfectly, and even in a case where a force acts so as to peel off the light-transmitting region and the polishing region during polishing, a sufficient resistance is effected to the peeling action. Therefore, peeling is hard to occur at the contact portions to thereby enable slurry leakage to be effectively prevented so as to enable optical detection of an endpoint to be achieved with high precision.

An Asker hardness A of the water non-permeable elastic member is preferably 80 degrees or less and more preferably 60 degrees or less. If an Asker hardness A exceeds 80 degrees, a strain or a dimensional change occurring in the light-transmitting region and the inserted portion thereof cannot be sufficiently absorbed and a tendency arises that the light-transmitting region protrudes or is deformed during polishing and the polishing pad is easier to be deformed.

The water non-permeable elastic member is preferably made of a water non-permeable resin composition containing a water non-permeable resin of at least one kind selected from the group consisting of a rubber, a thermoplastic elastomer and a reaction curable resin.

With the material adopted, the water non-permeable elastic member can be formed with ease, which makes the effect more excellent.

The water non-permeable elastic member is preferably lower in height than the annular groove. If a height of the water non-permeable elastic member is equal to or higher than the annular groove, the member protrudes from the surface of the pad during polishing, causing a scratch or tending to worsen polishing characteristics such as in-plane uniformity.

In the invention, a material of which the light-transmitting region is made is preferably a non-foam. Since a non-foam can suppress scattering of light, a correct reflectance can be detected, thereby enabling an optical detection precision of an endpoint in polishing to be raised.

An Asker hardness D of the light-transmitting region is preferably in the range of from 30 to 75 degrees. With a light-transmitting region having a hardness in the range adopted, occurrence of a scratch on a surface of a wafer can be suppressed. Moreover, occurrence of a physical damage on a surface of the light-transmitting region can also suppressed, thereby enabling optical detection of an endpoint with high precision to be performed with more of stability. If an Asker hardness D is less than 30 degrees, an abrasive grain in a slurry is easy to stick into a surface of the light-transmitting region and a scratch is easy to be generated on a silicon wafer by a stuck grain. Since the light-transmitting region is easy to be deformed, polishing characteristics such as in-plane uniformity is degraded or slurry leakage is easy to be occur. On the other hand, if an Asker hardness D exceeds 75 degrees, the light-transmitting region is excessively hard; therefore, a scratch is easier to be caused on a silicon wafer. Since a physical damage is easier to be caused on a surface of the light-transmitting region, transparency is reduced and an optical detection precision of an endpoint in polishing tends to decrease.

A polishing side surface of the light-transmitting region has preferably no depression and protrusion structure holding and renewing a polishing liquid. The term, a depression and protrusion structure, means a groove or a hole formed on a member surface by cutting or the like. If macroscopic surface depressions and protrusions exist on a polishing side surface of the light-transmitting region, a slurry containing additives such as abrasive grains is collected in depressions and scattering and absorption of light occur, which tends to affect detection precision. A surface of the water permeation protective layer has also preferably no macroscopic surface depressions and protrusions. If macroscopic surface depressions and protrusions exist, scattering of light is easy to occur, leading to an adverse possibility to exert an influence on detection precision.

In the invention, the material for forming the polishing region is preferably fine-cell foam. In the invention, the surface of the polishing region at the polishing side has preferably a depression and protrusion structure holding and renewing a polishing liquid.

Also, the average cell diameter of the fine-cell foam is preferably 70 μm or less, more preferably 50 μm or less. When the average cell diameter is 70 μm or less, planarity is improved.

The specific gravity of the fine-cell foam is preferably 0.5 to 1.0, more preferably 0.7 to 0.9. When the specific gravity is less than 0.5, the strength of the surface of the polishing region is lowered to reduce the planarity of an object of polishing, while when the specific gravity is higher than 1.0, the number of fine cells on the surface of the polishing region is decreased, and planarity is good, but the rate of polishing tends to be decreased.

The hardness of the fine-cell foam is preferably 45 to 85°, more preferably 45 to 65°, in terms of Asker D hardness. When the Asker D hardness is less than 45°, the planarity of an object of polishing is decreased, while when the planarity is greater than 85°, the planarity is good, but the uniformity of an object of polishing tends to be decreased.

The compressibility of the fine-cell foam is preferably 0.5 to 5.0%, more preferably 0.5 to 3.0%. When the compressibility is in this range, both planarity and uniformity can be satisfied. The compressibility is a value calculated from the above equation:

The compression recovery of the fine-cell foam is preferably 50 to 100%, more preferably 60 to 100%. When the compression recovery is less than 50%, the thickness of the polishing region is significantly changed as loading during polishing is repeatedly applied onto the polishing region, and the stability of polishing characteristics tends to be lowered. The compression recovery is a value calculated from the above equation:

The storage elastic modulus of the fine-cell foam at 40° C. at 1 Hz is preferably 200 MPa or more, more preferably 250 MPa or more. When the storage elastic modulus is less than 200 MPa, the strength of the surface of the polishing region is lowered and the planarity of an object of polishing tends to be reduced. The storage elastic modulus refers to the elastic modulus determined by measuring the fine-cell foam by applying sinusoidal wave vibration with a tensile testing jig in a dynamic viscoelastometer.

The invention relates to a method for manufacturing the polishing pad including: a step of laminating a cushion layer on a polishing layer having a polishing region and a aperture A for providing the light-transmitting region; a step of removing part of the cushion layer in the aperture A to form an aperture B smaller than the light-transmitting region in the cushion layer; a step of providing the light-transmitting region on the aperture B and in the aperture A; and a step of casting a water non-permeable resin composition into an annular groove existing between the aperture A and the light-transmitting region and curing the composition to thereby form a water non-permeable elastic member.

The invention relates to a method for manufacturing the polishing pad including: a step of laminating a polishing layer having a polishing region and an aperture A for providing the light-transmitting region and a cushion layer having an aperture B smaller than the light-transmitting region one on the other so that the apertures A and B are superimposed one on the other; a step of providing the light-transmitting region on the aperture B and in the aperture A; and a step of casting a water non-permeable resin composition into an annular groove existing between the aperture A and the light-transmitting region and curing the composition to thereby form a water non-permeable elastic member.

Third Invention

The invention relates to a polishing pad in which a polishing layer having a polishing region and a light-transmitting region, and a cushion layer having an aperture B smaller than the light-transmitting region are laminated one on the other so that the light-transmitting region and the aperture B are superimposed one on the other and an annular water non-permeable elastic member is provided over a contact portion between the rear surface of the light-transmitting region and a section of the aperture B so as to cover the contact portion.

In CMP, the polishing pad and an object to be polished such as a wafer are rotated about its center or revolved about a center outside thereof and polishing is effected by friction under pressure. Since various kinds of forces (especially, in a horizontal direction) act in the light-transmitting region and the polishing region during polishing, a peeling state always arises at the interface between both members. A conventional polishing pad is easy to be peeled off at the interface between the both members, it is thought, to create a clearance at the interface and to cause slurry leakage there. The slurry leakage causes optical problems such as clouding on an optical endpoint detecting section, which is thought to reduce detection precision of an endpoint or disable detection of an endpoint to be achieved.

On the other hand, a polishing pad of the invention has an annular water non-permeable elastic member over a contact portion between the rear surface of the light permissive region and a section of the aperture B so as to cover the contact portion. The water non-permeable elastic member has elasticity, no peeling off occurs even if a peeling force acts during polishing since a hardness is sufficiently low to thereby enable a contact portion between the rear surface of the light-transmitting region and a section of the aperture B to be perfectly sealed. Hence, even if a clearance is generated at the interface between the members to thereby allow the slurry to pass through the clearance, slurry leakage can be effectively prevented by the water non-permeable elastic member, thereby enabling detection of an optical endpoint with high precision to be realized.

The water non-permeable elastic member preferably has an Asker hardness A of 80 degrees or less and more preferably 60 degrees or less. If an Asker hardness A exceeds 80 degrees, easy peeling tends to occur from the rear surface of the light-transmitting region or the section of the aperture B when a peeling force acts during polishing.

The water non-permeable elastic member is preferably made of a water non-permeable resin composition containing a water non-permeable resin of at least one kind selected from the group consisting of a rubber, a thermoplastic elastomer and a reaction curable resin. With the material adopted, the water non-permeable elastic member can be formed with ease, which makes the effect more excellent.

In the invention, a material of which the light-transmitting region is made is preferably a non-foam. Since a non-foam can suppress scattering of light, a correct reflectance can be detected, thereby enabling an optical detection precision of an endpoint in polishing to be raised.

An Asker hardness D of the light-transmitting region is preferably in the range of from 30 to 75 degrees. With a light-transmitting region having a hardness in the range adopted, occurrence of a scratch on a surface of a wafer can be suppressed. Moreover, occurrence of a physical damage on a surface of the light-transmitting region can also suppressed, thereby enabling optical detection of an endpoint with high precision to be performed with more of stability. An Asker hardness D of the light-transmitting region is more preferably in the range of from 40 to 60 degrees. If an Asker hardness D is less than 30 degrees, an abrasive grain in a slurry is easy to stick into a surface of the light-transmitting region and a scratch is easy to be generated on a silicon wafer by a stuck grain. Since the light-transmitting region is easy to be deformed, polishing characteristics such as in-plane uniformity is degraded or slurry leakage is easy to be occur. On the other hand, if an Asker hardness D exceeds 75 degrees, the light-transmitting region is excessively hard; therefore, a scratch is easier to be caused on a silicon wafer. Since a physical damage is easier to be caused on a surface of the light-transmitting region, transparency is reduced and an optical detection precision of an endpoint in polishing tends to decrease.

A polishing side surface of the light-transmitting region has preferably no depression and protrusion structure holding and renewing a polishing liquid. The term, a depression and protrusion structure, means a groove or a hole formed on a member surface by cutting or the like. If macroscopic surface depressions and protrusions exist on a polishing side surface of the light-transmitting region, a slurry containing additives such as abrasive grains is collected in depressions and scattering and absorption of light occur, which tends to affect detection precision. A surface of the water permeation protective layer has also preferably no macroscopic surface depressions and protrusions. If macroscopic surface depressions and protrusions exist, scattering of light is easy to occur, leading to an adverse possibility to exert an influence on detection precision.

In the invention, the material for forming the polishing region is preferably fine-cell foam. In the invention, the surface of the polishing region at the polishing side has preferably a depression and protrusion structure holding and renewing a polishing liquid.

Also, the average cell diameter of the fine-cell foam is preferably 70 μm or less, more preferably 50 μm or less. When the average cell diameter is 70 μm or less, planarity is improved.

The specific gravity of the fine-cell foam is preferably 0.5 to 1.0, more preferably 0.7 to 0.9. When the specific gravity is less than 0.5, the strength of the surface of the polishing region is lowered to reduce the planarity of an object of polishing, while when the specific gravity is higher than 1.0, the number of fine cells on the surface of the polishing region is decreased, and planarity is good, but the rate of polishing tends to be decreased.

The hardness of the fine-cell foam is preferably 45 to 85°, more preferably 45 to 65°, in terms of Asker D hardness. When the Asker D hardness is less than 45°, the planarity of an object of polishing is decreased, while when the planarity is greater than 85°, the planarity is good, but the uniformity of an object of polishing tends to be decreased.

The compressibility of the fine-cell foam is preferably 0.5 to 5.0%, more preferably 0.5 to 3.0%. When the compressibility is in this range, both planarity and uniformity can be satisfied. The compressibility is a value calculated from the above equation:

The compression recovery of the fine-cell foam is preferably 50 to 100%, more preferably 60 to 100%. When the compression recovery is less than 50%, the thickness of the polishing region is significantly changed as loading during polishing is repeatedly applied onto the polishing region, and the stability of polishing characteristics tends to be lowered. The compression recovery is a value calculated from the above equation:

The storage elastic modulus of the fine-cell foam at 40° C. at 1 Hz is preferably 200 MPa or more, more preferably 250 MPa or more. When the storage elastic modulus is less than 200 MPa, the strength of the surface of the polishing region is lowered and the planarity of an object of polishing tends to be reduced. The storage elastic modulus refers to the elastic modulus determined by measuring the fine-cell foam by applying sinusoidal wave vibration with a tensile testing jig in a dynamic viscoelastometer.

The invention relates to a method for manufacturing the polishing pad including: a step of laminating a polishing layer having a polishing region and a light-transmitting region and a cushion layer having an aperture B smaller than the light-transmitting region one on the other so that the light-transmitting region and the aperture B are superimposed one on the other; and a step of coating a water non-permeable resin composition over a contact portion between the rear surface of the light-transmitting region and a section of the aperture B to cure the wet coat and to thereby form an annular water non-permeable elastic member so as to cover the contact portion.

The invention relates to a method for manufacturing the polishing pad including: a step of laminating a cushion layer on a polishing layer having a polishing region and an aperture A for providing the light-transmitting region so as to be inserted therein; a step of removing part of the cushion layer in the aperture A to form an aperture B smaller than the light-transmitting region in the cushion layer; a step of providing the light-transmitting region on the aperture B and in the aperture A; and a step of coating a water non-permeable resin composition over a contact portion between the rear surface of the light-transmitting region and a section of the aperture B to cure the wet coat and to thereby form an annular water non-permeable elastic member so as to cover the contact portion.

The invention relates to a method for manufacturing the polishing pad including: a step of laminating a polishing layer having a polishing region and an aperture A for providing the light-transmitting region so as to be inserted therein and a cushion layer having the aperture B smaller than the light-transmitting region one on the other so that the apertures A and B are superimposed one on the other; a step of providing the light-transmitting region on the aperture B and in the aperture A; and a step of coating a water non-permeable resin composition over a contact portion between the rear surface of the light-transmitting region and a section of the aperture B to cure the wet coat and to thereby form an annular water non-permeable elastic member so as to cover the contact portion.

Fourth Invention

The invention relates to a polishing pad having a polishing region and a light-transmitting region, wherein a compressibility of the light-transmitting region is more than a compressibility of the polishing region.

A CMP method is a method in which a wafer, which is an object to be polished, is pressed against a polishing pad by a pressurizing mechanism and the wafer slides in the pressurized state to thereby effect polishing. Since the polishing region and the light-transmitting region are usually different in material or structure from each other and behaviors of both members during polishing of a CMP method are different from each other because of small differences in stress and wear therebetween, it is thought that the differences between the polishing region and the light-transmitting region are progressively increases with time in use. Moreover, it is thought that with increase in behavior differences, the light-transmitting region protrudes from the flat surface of the polishing pad, resulting in degradation in polishing characteristics or in generation of a scratch on a wafer.

The inventors have found that protrusion of the light-transmitting region from a surface of the polishing pad during polishing can be prevented by rendering a compressibility of the light-transmitting region more than that of the polishing region even in a case where a difference in behavior between the polishing region and the light-transmitting region increases with time of use, thereby enabling degradation in polishing characteristics and generation of a scratch to be suppressed.

A compressibility of the light-transmitting region is preferably in the range of from 1.5 to 10% and more preferably in the range of from 2 to 5%. If a compressibility thereof is less than 1.5%, a scratch tends to be generated by the light-transmitting region even if a compressibility of the light-transmitting region is more than that of the polishing region. On the other hand, if a compressibility thereof exceeds 10%, polishing characteristics (such as planarization characteristic or in-plane uniformity) tends to be degraded even if a compressibility of the light-transmitting region is more than that of the polishing region.

A compressibility of the polishing region is preferably in the range of from 0.5 to 5% and more preferably in the range of from 0.5 to 3%. If a compressibility of the polishing region is less than 0.5%, in-plane uniformity tends to be degraded. On the other hand, a compressibility thereof exceeds 5%, planarization characteristic tends to be worsened. Note that a compressibility is a value calculated with the equation.

A light transmittance of the light-transmitting region is preferably 80% or more at a wavelength over all the region of from 500 to 700 nm in wavelength.

As described above, used as a light beam are He—Ne laser light, white light emitted from a halogen lamp and the like, and in a case where white light is employed, light with various wavelengths can be launched onto a wafer, which leads to an advantage that many profiles of a surface of the wafer can be obtained. Since detection precision of a polishing endpoint and a measurement precision of a film thickness can be raised with decrease in attenuation of intensity of light passing through the light-transmitting region, a level of a light transmittance at a measurement light wavelength in use is important to determine a detection precision of a polishing endpoint and a measurement precision of a film thickness. From the viewpoint described above, it is preferable to use a light-transmitting region in which attenuation of a light transmittance can be smaller on the shorter wavelength side, while a detection precision can be highly maintained over a wide wavelength range.

A Shore hardness A of a light-transmitting region is preferably 60 degrees or more and more preferably in the range of from 65 to 90 degrees. If a Shore hardness A is less than 60 degrees, a light-transmitting region is easy to be deformed, there arises a adverse possibility to cause water leakage (slurry leakage) from between the polishing region and the light-transmitting region.

In the invention, a material of which the light-transmitting region is made is preferably a non-foam. Since a non-foam can suppress scattering of light, a correct reflectance can be detected, thereby enabling an optical detection precision of an endpoint in polishing to be raised.

A polishing side surface of the light-transmitting region has preferably no depression and protrusion structure holding and renewing a polishing liquid. The term, a depression and protrusion structure, means a groove or a hole formed on a member surface by cutting or the like. If macroscopic surface depressions and protrusions exist on a polishing side surface of the light-transmitting region, a slurry containing additives such as abrasive grains is collected in depressions and scattering and absorption of light occur, which tends to affect detection precision. A surface of the water permeation protective layer has also preferably no macroscopic surface depressions and protrusions. If macroscopic surface depressions and protrusions exist, scattering of light is easy to occur, leading to an adverse possibility to exert an influence on detection precision.

In the invention, the material for forming the polishing region is preferably fine-cell foam. In the invention, the surface of the polishing region at the polishing side has preferably a depression and protrusion structure holding and renewing a polishing liquid. Also, the average cell diameter of the fine-cell foam is preferably 70 μm or less, more preferably 50 μm or less. When the average cell diameter is 70 μm or less, planarity is improved.

The specific gravity of the fine-cell foam is preferably 0.5 to 1.0, more preferably 0.7 to 0.9. When the specific gravity is less than 0.5, the strength of the surface of the polishing region is lowered to reduce the planarity of an object of polishing, while when the specific gravity is higher than 1.0, the number of fine cells on the surface of the polishing region is decreased, and planarity is good, but the rate of polishing tends to be decreased.

The compression recovery of the fine-cell foam is preferably 50 to 100%, more preferably 60 to 100%. When the compression recovery is less than 50%, the thickness of the polishing region is significantly changed as loading during polishing is repeatedly applied onto the polishing region, and the stability of polishing characteristics tends to be lowered. The compression recovery is a value calculated from the above equation:

The storage elastic modulus of the fine-cell foam at 40° C. at 1 Hz is preferably 200 MPa or more, more preferably 250 MPa or more. When the storage elastic modulus is less than 200 MPa, the strength of the surface of the polishing region is lowered and the planarity of an object of polishing tends to be reduced. The storage elastic modulus refers to the elastic modulus determined by measuring the fine-cell foam by applying sinusoidal wave vibration with a tensile testing jig in a dynamic viscoelastometer.

Fifth Invention

The invention relates to a polishing pad having a polishing region and a light-transmitting region, wherein the polishing region and the light-transmitting region have a concentration of Fe of 0.3 ppm or less, a concentration of Ni of 1.0 ppm or less, a concentration of copper of 0.5 ppm or less, a concentration of zinc of 0.1 ppm or less and a concentration of Al of 1.2 ppm or less.

The inventors have found that as shown in FIGS. 14 to 20, a kind and a concentration of a metal contained in a material of which a polishing pad is made exert a greatly different influence on a product yield of a device. For example, a concentration of Fe contained in a material of which a polishing pad is made exerts a great influence on a product yield of a device, while concentrations of Mg and Cr exert almost no influence on a product yield of a device. The inventors have found that Fe, Ni, Cu, Zn and Al exert great influences on a product yield of a device. The inventors have further found that if a concentration of each of the metals contained in a material of which a polishing pad is made exceeds a threshold value specific to the corresponding metal, a product yield of a device is greatly reduced.

A concentration value of each of the metals is a threshold value and if a concentration of even one of the metals exceeds the corresponding threshold value, a product yield of a device is greatly reduced.

In the invention, a material of the polishing region and the light-transmitting region are preferably a polymer of at least one kind selected from the group consisting of a polyolefin resin, a polyurethane resin, a (meth)acrylic resin, a silicone resin, a fluororesin, a polyester resin, a polyamide resin, a polyamideimide resin and a photosensitive resin and especially preferable is a polyurethane resin.

With a polishing pad of the invention employed, concentrations of the metals on a wafer can be decreased. Hence, a wafer cleaning step can be performed in a simple way; and not only can process steps be efficiently conducted and a manufacturing cost be reduced, but a burden imposed on a wafer in the cleaning step can also be decreased; thereby, enabling a product yield of a semiconductor device to be improved.

The first to fifth inventions relate to a method of producing a semiconductor device, which comprises a step of polishing the surface of a semiconductor wafer with the polishing pad described above.

DETAILED DESCRIPTION OF THE PREFERRED EXAMPLES

First Invention

Figure 3:
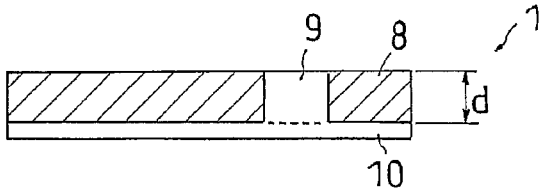
FIG. 3 is a schematic sectional view showing an example of a polishing pad of a first invention.

A polishing pad 1 of the invention has, as shown in FIG. 3, a polishing region 8 and a light-transmitting region 9, a water permeation preventive layer 10 is provided on one surfaces of the polishing region 8 and the light-transmitting region 9 and the light-transmitting region 9 and the water permeation preventive layer 10 are formed with the same material integrally into a single piece.

No specific limitation is imposed on a material of which the light-transmitting region and the water permeation preventive layer are made, but a light transmittance thereof is preferably 20% or more and more preferably 50% or more at a wavelength over all the range of from 400 to 700 nm in wavelength. Examples of such a material include: thermoset resins such as a polyurethane resin, a polyester resin, a phenol resin, a urea resin, a melamine resin, an epoxy resin and an acrylic resin; thermoplastic resins such as a polyurethane resin, a polyester resin, a polyamide resin, a cellulose-based resin, an acrylic resin, a polycarbonate, a halogen containing resin (polyvinyl chloride, polytetrafluoroethylene, polyvinylidene fluoride and the like), a polystyrene and an olefinic resin (polyethylene, polypropylene and the like); and rubbers such as a butadiene rubber and an isoprene rubber; light curable resins curable with irradiation of light such as ultraviolet and an electron beam; and photosensitive resins. The resins may be used either alone or in combination of two or more kinds. Note that a thermoset resin is preferably cured at a comparative low temperature. In a case where a light curable resin is employed, a photo-polymerization initiator is preferably employed together.

A material of a light-transmitting region and a water permeation preventive layer is preferably selected in consideration of adherence (closely adhering property) to a material used in a polishing region, a thermal stability of a polishing region and a manufacturing apparatus.

Any of resins curable by a reaction with light is used as a light curable resin without imposing any limitation thereon. Resins having an ethylenic unsaturated hydrocarbon group are exemplified. To be concrete, examples thereof include: polyhydric alcohol-based (meth)acrylates such as diethyleneglycol dimethacrylate, tetraethyleneglycol diacrylate, hexapropylene glycol diacrylate, trimethylolpropane triacrylate, pentaerythritol triacrylate, 1,6-hexanediol diacrylate, 1,9-nonanediol diacrylate, dipentaerythritol pentaacrylate, trimethylolpropane trimethacrylate and origobutadienediol diacrylate; epoxy(meth)acrylates such as 2,2-bis(4-(meth) acryloxyethoxyphenyl)propane and (meth)acrylic acid adducts of bisphenol A or epichlorohydrin-based epoxy resin; low molecular unsaturated polyesters such as a condensate of phthalic anhydride-neopentylglycol-acrylic acid; a urethane (meth)acrylate compound obtained by a reaction between trimethylhexamethylene diisocyanate, a dihydric alcohol and a (meth)acrylic acid monoester; methoxypolyethylene glycol (meth)acrylate; methoxypolypropylene glycol (meth)acrylate; phenoxypolyethylene glycol (meth)acrylate; phenoxypolypropylene glycol (meth)acrylate; nonylphenoxypolyethylene glycol (meth)acrylate; and nonylphenoxypolypropylene glycol (meth)acrylate. The above resins may be used either alone or in combination of two or more kinds.

In order to enhance light curability of a light curable resin, a photo-polymerization initiator, a sensing agent or the like can be added thereto. No specific limitation is imposed thereon and an additive is employed by selecting according to a light source or a wavelength band in use.

In a case where ultraviolet in the vicinity of i-line (365 nm) is used as a light source, examples of the additives include: aromatic ketones such as benzophenone, 4,4'-bis(dimethylamino)benzophenone, 4,4'-bis(diethylamino)benzophenone, 4-methoxy-4'-dimethylaminobenzophenone, 2-benzyl-2-dimethylamino-1-(4-morphorinophenyl)-butane-1-one, 2-ethylanthraquinone and phenanthrenequinone; benzoins such as methylbenzoin and ethylbenzoin; benzyl derivatives such as benzyldimethyl ketal; imidazoles such as 2-(o-chlorophenyl)-4,5-diphenylimidazole dimer, 2-(o-chlorophenyl)-4,5-di(m-methoxyphenyl)imidazole dimer, 2-(o-fluorophenyl)-4,5-phenylimidazole dimer, 2-(o-methoxyphenyl)-4,5-diphenylimidazole dimer, 2-(p-methoxyphenyl)-4,5-diphenylimidazole dimer and 2-(2,4-dimethoxyphenyl)-4,5-diphenylimidazole dimer; acridine derivatives such as 9-phenylacridine and 1,7-bis(9,9'-acridinyl)heptane; and N-phenylglycine. The additives may be used either alone or in combination of two or more kinds.

No specific limitation is placed on a photosensitive resin and any of resins causing a chemical reaction by irradiation with light can be used and to be concrete, examples thereof include:

(1) Polymers each having a compound including an active ethylene group or an aromatic polycyclic compound introduced to a main chain or a side chain thereof, examples of which include: polyvinyl cinnamate; an unsaturated polyester obtained by condensation polymerization of p-phenylene diacrylic acid with glycol; cinnamylidene acetic acid esterified with polyvinyl alcohol; and polymers each having a main chain or a side chain thereof introduced thereto with a photosensitive functional group such as a cinnamoil group, a cinnamylidene group, a carcon residue, an isocoumarin residue, 2,5-dimethoxystilbene residue, stylylpyridinium residue, tymine residue, α-phenylmaleimide, anthracene residue and 2-pyron residue.

(2) Polymers each having a diazo group or an azido group introduced to a main chain or a side chain thereof, examples of which include: a paraformaldehyde condensate with p-diazodiphenylamine, a formaldehyde condensate with benzenediazodium-4-(phenylamino) phosphate, a formaldehyde condensate with a methoxybenzenediazodium-4-(phenylamino) salt adduct, polyvinyl-p-azidobenzal resin and azidoacrylate.

(3) Polymers each having a phenol ester introduced to a main chain or a side chain thereof, examples of which include: a polymer in which an unsaturated carbon-carbon double bond such as (meth)acryloyl group is introduced, an unsaturated polyester, an unsaturated polyurethane, an unsaturated polyamide, a poly(meth)acrylic acid in which an unsaturated carbon-carbon double bond is introduced through an ester bond to a side chain thereof, an epoxy (meth) acrylate and novolak (meth)acrylate.

Various kinds of photosensitive polyimides, photosensitive polyamides, photosensitive polyamideimide, and a combination of a phenol resin and an azido compound can be used. Moreover, an epoxy resin or a polyamide in which a chemically crosslinkable site is introduced can be used in combination with a photo-cationic polymerization initiator. Still moreover, natural rubber, synthetic rubber or cyclized rubber can be used in combination with a bisazido compound.

A material in a light-transmitting region is preferably a material more excellent in cutting property than in polishing region. The term, a cutting property, means a level at which the material is removed during polishing or by a dresser. In the above case, the light-transmitting region does not protrude from the polishing region and a scratch on an object to be polished or a dechuck error during polishing can be prevented from occurring.

A material used in the light-transmitting region is preferably a material used in a polishing region or a material analogous to a material used in the polishing region in physical properties. Especially preferable is a polyurethane resin controllable of light scattering due to dressing marks during polishing and high in wear resistance.

The polyurethane resin comprises an organic isocyanate, a polyol (high-molecular-weight polyol and low-molecular-weight polyol) and a chain extender.

The organic isocyanate includes 2,4-toluene diisocyanate, 2,6-toluene diisocyanate, 2,2'-diphenylmethane diisocyanate, 2,4'-diphenylmethane diisocyanate, 4,4'-diphenylmethane diisocyanate, 1,5-naphthalene diisocyanate, p-phenylene diisocyanate, m-phenylene diisocyanate, p-xylylene diisocyanate, m-xylylene diisocyanate, hexamethylene diisocyanate 1,4-cyclohexan diisocyanate, 4,4'-dicyclohexylmethane diisocyanate, isophorone diisocyanate etc. These may be used alone or as a mixture of two or more thereof.

The usable organic isocyanate includes not only the isocyanate compounds described above but also multifunctional (trifunctional or more) polyisocyanate compounds. As the multifunctional isocyanate compounds, Desmodule-N (manufactured by Bayer Ltd.) and a series of diisocyanate adduct compounds under the trade name of Duranate (Asahi Kasei Corporation) are commercially available. Because the trifunctional or more polyisocyanate compound, when used singly in synthesizing a prepolymer, is easily gelled, the polyisocyanate compound is used preferably by adding it to the diisocyanate compound.

The high-molecular-weight polyol includes polyether polyols represented by polytetramethylene ether glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, and polycarbonate polyols obtained by ester exchange reaction of a polyhydroxyl compound with aryl carbonate. These may be used singly or as a mixture of two or more thereof.

The polyol includes not only the above high-molecular-weight polyols but also low-molecular-weight polyols such as ethylene glycol, 1,2-propylene glycol, 1,3-propylene glycol, 1,4-butane diol, 1,6-hexane diol, neopentyl glycol, 1,4-cyclohexane dimethanol, 3-methyl-1,5-pentane diol, diethylene glycol, triethylene glycol, 1,4-bis(2-hydroxyethoxy) benzene etc.

The chain extender includes low-molecular-weight polyols such as ethylene glycol, 1,2-propylene glycol, 1,3-propylene glycol, 1,4-butane diol, 1,6-hexane diol, neopentyl glycol, 1,4-cyclohexane dimethanol, 3-methyl-1,5-pentane diol, diethylene glycol, triethylene glycol, 1,4-bis(2-hydroethoxy) benzene etc., and polyamines such as 2,4-toluene diamine, 2,6-toluene diamine, 3,5-diethyl-2,4-toluene diamine, 4,4'-di-sec-butyl-diaminodiphenyl methane, 4,4'-diaminodiphenyl methane, 3,3'-dichloro-4,4'-diaminodiphenyl methane, 2,2',3,3'-tetrachloro-4,4'-diaminodiphenyl methane, 4,4'-diamino-3,3'-diethyl-5,5'-dimethyl diphenyl methane, 3,3'-diethyl-4,4'-diaminodiphenyl methane, 4,4'-methylene-bis-methyl anthranylate, 4,4'-methylene-bis-anthranylic acid, 4,4'-diaminodiphenyl sulfone, N,N'-di-sec-butyl-p-phenylene diamine, 4,4'-methylene-bis(3-chloro-2,6-diethylamine), 3,3'-dichloro-4,4'-diamino-5,5'-diethyl diphenyl methane, 1,2-bis(2-aminophenylthio) ethane, trimethylene glycol-di-p-aminobenzoate, 3,5-bis(methylthio)-2,4-toluene diamine etc. These may be used singly or as a mixture of two or more thereof. However, the polyamine is often colored by itself, and resin using the same is also colored, and thus the polyamine is blended preferably in such a range that the physical properties and light transmittance are not deteriorated. When the compound having an aromatic hydrocarbon group is used, the light transmittance in the short-wavelength side tends to be decreased, and thus such compound is preferably not used, but may be blended in such a range that the required transmittance is not deteriorated.

The proportion of the organic isocyanate, the polyol and the chain extender in the polyurethane resin can be changed suitably depending on their respective molecular weights, desired physical properties of the light-transmitting region produced therefrom, etc. To allow the light-transmitting region to achieve the above properties, the ratio of the number of isocyanate groups of the organic isocyanate to the number of functional groups in total (hydroxyl group+amino group) in the polyol and the chain extender is preferably 0.95 to 1.15, more preferably 0.99 to 1.10. The polyurethane resin can be polymerized by known urethane-making techniques such as a melting method, a solution method etc., but in consideration of cost and working atmosphere, the polyurethane resin is formed preferably by the melting method.

A polymerization procedure for a polyurethane resin can be either a prepolymer method or a one shot method and, from the viewpoint of stability and transparency of a polyurethane resin during polishing, preferable is the prepolymer method in which an isocyanate terminated prepolymer is synthesized from an organic isocyanate and a polyol in advance, and a chain extender is reacted with the prepolymer. An NCO wt % of the prepolymer is preferably on the order in the range of from 2 to 8 wt % and more preferably on the order in the range of from 3 to 7 wt %. If an NCO wt % is less than 2 wt %, reaction curing takes an excessively long time and arises a tendency to reduce a productivity, while if an NCO wt % exceeds 8 wt %, a reaction velocity is excessively fast to thereby cause air inclusion or the like and a tendency arises that deteriorates physical characteristics such as transparency and a light transmittance.

When there are bubbles in the light-transmitting region, the decay of reflected light becomes significant due to light scattering, thus reducing the accuracy of detection of polishing endpoint and the accuracy of measurement of film thickness. Accordingly, gas contained in the material before mixing is sufficiently removed under reduced pressure at 10 Torr or less. In the case of a usually used stirring blade mixer, the mixture is stirred at a revolution number of 100 rpm or less so as not to permit bubbles to be incorporated into it in the stirring step after mixing. The stirring step is also preferably conducted under reduced pressure. When a rotating mixer is used, bubbles are hardly mixed even in high rotation, and thus a method of stirring and deforming by using this mixer is also preferable.

The shape and size of the light-transmitting region are not particularly limited, but are preferably similar to the shape and size of the opening of the polishing region.

Though no specific limitation is placed on a thickness (d) of a light-transmitting region, it is preferably that a thickness (d) thereof is equal to or less than that of a polishing region. To be concrete, a thickness (d) is on the order in the range of from 0.5 to 6 mm and preferably on the order in the range of from 0.6 to 5 mm. If a thickness of a light-transmitting region is more than that of a polishing region, an adverse possibility arises that causes a scratch on a silicon wafer by the action of a protruded portion during polishing. Since a light-transmitting region has an unfavorable possibility to be deformed by a stress acting thereon during polishing and has an optically large strain, an adverse possibility occurs that reduces an optical detection precision of an endpoint. On the other hand, if a thickness of a light-transmitting region is excessively thin, durability is insufficient and a large recess occurs on the upper surface of the light-transmitting region to collect a lot of a slurry and to thereby cause an unfavorable possibility to reduce a detection precision of an optical endpoint.

The scatter of the thickness of the light-transmitting region is preferably 100 μm or less, more preferably 50 μm or less, particularly preferably 30 μm or less. When the scatter of the thickness is higher than 100 μm, large undulation is caused to generate portions different in a contacting state with an object of polishing, thus influencing polishing characteristics (in-plane uniformity and planarizing property etc.).

The method of suppressing the scatter of thickness includes a method of buffing the surface of a light-transmitting region. Buffing is conducted preferably stepwise by using polishing sheets different in grain size. When the light-transmitting region is subjected to buffing, the surface roughness is preferably lower. When the surface roughness is high, incident light is irregularly reflected on the surface of the light-transmitting region, thus reducing transmittance and reducing detection accuracy.

Though no specific limitation is imposed on a thickness of a water permeation preventive layer, a thickness thereof is usually on the order in the range of from 0.01 to 5 mm. In a case where a cushion layer is laminated on one surface of the water permeation preventive layer, a thickness thereof is more preferably on the order in the range of from 0.01 to 1.5 mm, while in a case where a cushioning effect is imparted to a water permeation preventive layer itself without laminating a separate cushion layer on the water permeation preventive layer, a thickness thereof is more preferably on the order in the range of from 0.5 to 5 mm.

The scatter of the thickness of the water permeation preventive layer is preferably 50 μm or less, more preferably 30 μm or less. When the scatter of the thickness is higher than 50 μm, large undulation is caused to generate portions different in a contacting state with an object of polishing, thus influencing polishing characteristics (in-plane uniformity and planarizing property etc.). The method of suppressing the scatter of thickness includes a method of buffing the surface of a water permeation preventive layer.

The material for forming the polishing region includes, for example, polyurethane resin, polyester resin, polyamide resin, acrylic resin, polycarbonate resin, halogenated resin (polyvinyl chloride, polytetrafluoroethylene, polyvinylidene fluoride etc.), polystyrene, olefinic resin (polyethylene, polypropylene etc.), epoxy resin, and photosensitive resin. These may be used alone or as a mixture of two or more thereof. The material for forming the polishing region may have a composition identical with, or different from, that of the light-transmitting region, but is preferably the same material as that of the light-transmitting region.

The polyurethane resin is a particularly preferable material because it is excellent in abrasion resistance and serves as a polymer having desired physical properties by changing the composition of its starting materials.

The polyurethane resin comprises an organic isocyanate, a polyol (high-molecular-weight polyol and low-molecular-weight polyol) and a chain extender.

The organic isocyanate used is not particularly limited, and for example, the organic isocyanate described above can be mentioned.

The high-molecular-weight polyol used is not particularly limited, and for example, the high-molecular-weight polyol described above can be mentioned. The number-average molecular weight of the polyol is not particularly limited, but is preferably about 500 to 2000, more preferably 500 to 1500, from the viewpoint of the elastic characteristics and the like of the resulting polyurethane. When the number-average molecular weight is less than 500, the polyurethane obtained therefrom does not have sufficient elastic characteristics, thus becoming a brittle polymer. Accordingly, a polishing pad produced from this polyurethane is rigid to cause scratch of the polished surface of an object of polishing. Further, because of easy abrasion, such polyurethane is not preferable from the viewpoint of the longevity of the pad. On the other hand, when the number-average molecular weight is higher than 2000, polyurethane obtained therefrom becomes soft, and thus a polishing pad produced from this polyurethane tends to be inferior in planarizing property.

As the polyol, not only the high-molecular-weight polyols mentioned above, but also low-molecular-weight polyols mentioned above can be simultaneously used.

The ratio of the high-molecular component to the low-molecular component in the polyol is determined depending on characteristics required of the polishing region produced therefrom.

The chain extender includes polyamines such as 4,4'-methylene bis(o-chloroaniline), 2,6-dichloro-p-phenylene diamine, 4,4'-methylene bis(2,3-dichloroaniline) etc., or the above-described low-molecular-weight polyols. These may be used singly or as a mixture of two or more thereof.

The proportion of the organic isocyanate, the polyol and the chain extender in the polyurethane resin can be changed suitably depending on their respective molecular weights, desired physical properties of the polishing region produced therefrom, etc. To obtain the polishing region excellent in polishing characteristics, the ratio of the number of isocyanate groups of the organic isocyanate to the number of functional groups in total (hydroxyl group+amino group) in the polyol and the chain extender is preferably 0.95 to 1.15, more preferably 0.99 to 1.10.

The polyurethane resin can be produced by the same method as described above. A stabilizer such as an antioxidant etc., a surfactant, a lubricant, a pigment, a filler, an antistatic and other additives may be added if necessary to the polyurethane resin.

The polyurethane resin is preferably fine-cell foam. When the fine-cell foam is used, slurry can be retained on cells of the surface to increase the rate of polishing.

The method of finely foaming the polyurethane resin includes, but is not limited to, a method of adding hollow beads and a method of forming foam by mechanical foaming, chemical foaming etc. These methods can be simultaneously used, but the mechanical foaming method using an active hydrogen group-free silicone-based surfactant consisting of a polyalkyl siloxane/polyether copolymer is more preferable. As the silicone-based surfactant, SH-192 (Toray Dow Corning Silicone Co., Ltd.) can be mentioned as a preferable compound.

An example of the method of producing closed-cell polyurethane foam used in the polishing region is described below. The method of producing such polyurethane foam has the following steps.

(1) Stirring Step of Preparing a Cell Dispersion of an Isocyanate-Terminated Prepolymer A silicone-based surfactant is added to an isocyanate-terminated prepolymer and stirred in an inert gas, and the inert gas is dispersed as fine cells to form a cell dispersion. When the isocyanate-terminated prepolymer is in a solid form at ordinary temperatures, the prepolymer is used after melted by pre-heating to a suitable temperature.

(2) Step of Mixing a Curing Agent (Chain Extender)

A chain extender is added to, and mixed with, the cell dispersion under stirring.

(3) Curing Step

The isocyanate-terminated prepolymer mixed with the chain extender is cast in a mold and heat-cured.

The inert gas used for forming fine cells is preferably not combustible, and is specifically nitrogen, oxygen, a carbon dioxide gas, a rare gas such as helium and argon, and a mixed gas thereof, and the air dried to remove water is most preferable in respect of cost.

As a stirrer for dispersing the silicone-based surfactant-containing isocyanate-terminated prepolymer to form fine cells with the inert gas, known stirrers can be used without particular limitation, and examples thereof include a homogenizer, a dissolver, a twin-screw planetary mixer etc. The shape of a stirring blade of the stirrer is not particularly limited either, but a whipper-type stirring blade is preferably used to form fine cells.

In a preferable mode, different stirrers are used in stirring for forming a cell dispersion in the stirring step and in stirring for mixing an added chain extender in the mixing step, respectively. In particular, stirring in the mixing step may not be stirring for forming cells, and a stirrer not generating large cells is preferably used. Such a stirrer is preferably a planetary mixer. The same stirrer may be used in the stirring step and the mixing step, and stirring conditions such as revolution rate of the stirring blade are preferably regulated as necessary.

In the method of producing the polyurethane foam with fine cells, heating and post-curing of the foam obtained after casting and reacting the cell dispersion in a mold until the dispersion lost fluidity are effective in improving the physical properties of the foam, and are extremely preferable. The cell dispersion may be cast in a mold and immediately post-cured in a heating oven, and even under such conditions, heat is not immediately conducted to the reactive components, and thus the diameters of cells are not increased. The curing reaction is conducted preferably at normal pressures to stabilize the shape of cells.

In the production of the polyurethane resin, a known catalyst promoting polyurethane reaction, such as tertiary amine- or organotin-based catalysts, may be used. The type and amount of the catalyst added are determined in consideration of flow time in casting in a predetermined mold after the mixing step.

Production of the polyurethane foam may be in a batch system where each component is weighed out, introduced into a vessel and mixed or in a continuous production system where each component and an inert gas are continuously supplied to, and stirred in, a stirring apparatus and the resulting cell dispersion is transferred to produce molded articles.

The polishing region serving as a polishing layer is produced by cutting the above prepared polyurethane foam into a piece of predetermined size.

A polishing region of the invention is preferably provided with a depression and a protrusion structure for holding and renewing a slurry. Though in a case where the polishing region is formed with a fine foam, many openings are on a polishing surface thereof which works so as to hold the slurry, a depression and protrusion structure are preferably provided on the surface of the polishing side thereof in order to achieve more of holdability and renewal of the slurry or in order to prevent induction of dechuck error, breakage of a wafer or decrease in polishing efficiency. The shape of the depression and protrusion structure is not particularly limited insofar as slurry can be retained and renewed, and examples include latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These depression and protrusion structure are generally those having regularity, but the groove pitch, groove width, groove depth etc. can also be changed at each certain region to make retention and renewal of slurry desirable.

The method of forming the depression and protrusion structure is not particularly limited, and for example, formation by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like.

No specific limitation is placed on a thickness of a polishing region, but a thickness thereof is preferably on the same order as a thickness of a light-transmitting region (on the order in the range of from 0.5 to 6 mm) and more preferably on the order in the range of from 0.6 to 5 mm. The method of preparing the polishing region of this thickness includes a method wherein a block of the fine-cell foam is cut in predetermined thickness by a slicer in a bandsaw system or a planing system, a method that involves casting resin into a mold having a cavity of predetermined thickness and curing the resin, a method of using coating techniques and sheet molding techniques, etc.

The scatter of the thickness of the polishing region is preferably 100 μm or less, more preferably 50 μm or less. When the scatter of the thickness is higher than 100 μm, large undulation is caused to generate portions different in a contacting state with an object of polishing, thus adversely influencing polishing characteristics. To solve the scatter of the thickness of the polishing region, the surface of the polishing region is dressed generally in an initial stage of polishing by a dresser having abrasive grains of diamond deposited or fused thereon, but the polishing region outside of the range described above requires a longer dressing time to reduce the efficiency of production. As a method of suppressing the scatter of thickness, there is also a method of buffing the surface of the polishing region having a predetermined thickness. Buffing is conducted preferably stepwise by using polishing sheets different in grain size.

No specific limitation is placed on a method for fabricating a polishing region, a light-transmitting region and a water permeation preventive layer of the invention and various fabrication methods can be designed. Description will be given of a concrete example below.

Figure 4:
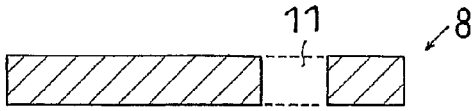
FIG. 4 is a schematic sectional view showing an example of a polishing region at which an aperture is provided.
Figure 5:
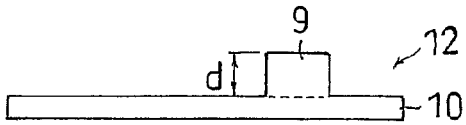
FIG. 5 is a schematic view of a structure showing an example of a transparent member into which a light-transmitting region and a water permeation preventive layer are formed integrally as a single piece.

FIG. 4 is a schematic view of a structure of the polishing region 8 provided with an aperture 11 and FIG. 5 is a schematic view of a structure of a transparent member 12 into which the light-transmitting region 9 and the water permeation preventive layer 10 are integrally formed as a single piece.

Methods for forming an aperture in part of a polishing region are exemplified as follows: 1) a method in which a resin sheet with a predetermined thickness is obtained from a resin block which has been produced using a band saw type or a planer type slicer. Then a cutting tool is pressed against the sheet to form an aperture, and 2) a method in which a polishing region forming material is cast into a mold with a shape to form an aperture and then the cast material is cured to thereby form the aperture. Note that no specific limitation is placed on a size and shape of the aperture.

Figure 7:
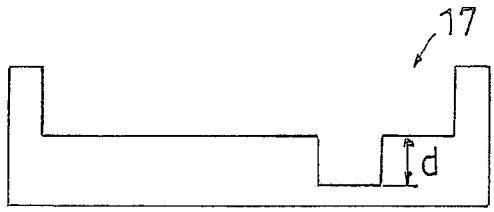
FIG. 7 is a schematic sectional view showing an example of a mold having shapes of a light transmitting region and a water permeation preventive layer.

On the other hand, methods for fabricating a transparent member into which a light-transmitting region and a water permeation preventive layer are integrally formed as a single piece are exemplified as follows: a method in which a resin material is cast into a mold (see FIG. 7) having a shape to form the light-transmitting region and the water permeation preventive layer to cure the resin material and a method in which a coating technique or a sheet forming technique is employed. According to the methods, since no interface exists between the light-transmitting region and the water permeation preventive layer, scattering of light can be suppressed and optical detection of an endpoint can be achieved with high precision. Note that in a case where the transparent member is fabricated with one of the methods, the resin material is preferably used at the optimal viscosity by controlling a temperature. Alternatively, it is a preferable method that a resin material is dissolved into a solvent to prepare a solution with the optimal viscosity and then cast, followed by removal of the solvent.

Then, the light-transmitting region of the transparent member is fittingly inserted into the aperture of the polishing region to thereby laminate the polishing region and the transparent member one on the other, thereby enabling a polishing pad of the invention to be manufactured.

A method in which a double sided tape is sandwiched between the polishing region and the transparent member, followed by pressing is exemplified as a means for laminating the polishing region and the transparent member one on the other. Alternatively, an adhesive may be coated on a surface, followed by adhesion.

The double-coated tape has a general constitution wherein an adhesive layer is arranged on both sides of a base material such as a nonwoven fabric or a film. The composition of the adhesive layer includes, for example, a rubber-based adhesive and an acrylic adhesive. In consideration of the content of metallic ion, the acrylic adhesive is preferable because of a lower content of metallic ion.

Figure 6:
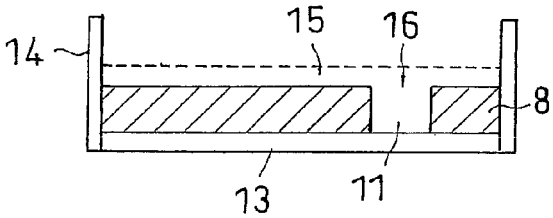
FIG. 6 is a schematic view of a process for manufacturing a polishing pad of the first invention by means of a casting method.

FIG. 6 is a schematic view of a process for manufacturing a polishing pad by means of a cast molding method.

A polishing region 8 in which an aperture 11 is formed is fabricated by means of a method similar to that as described above. Then, a release film 13 is temporarily attached to the polishing surface side of the polishing region 8, which is placed in a mold frame 14. Thereafter, a resin material 16 is cast into a space section 15 for forming a light-transmitting region 9 and a water permeation preventive layer 10 to cure the resin material 16 and to thereby, mold a transparent member 12 into which the light-transmitting region 9 and the water permeation preventive layer 10 are formed integrally as a single piece. Then, the transparent member 12 is taken out of the mold frame to separate a release film therefrom, thereby enabling a polishing pad of the invention to be manufactured. With the manufacturing method adopted, no interface is present between the light-transmitting region and the water permeation preventive layer; therefore, scattering of light can be suppressed and optical detection of an endpoint with high precision can be achieved. With the manufacturing method adopted, the polishing region and the transparent member can be closely adhered to each other; therefore, slurry leakage can be effectively prevented.

Another manufacturing method is exemplified as follows. A polishing region with an aperture formed therein is fabricated and then, a water permeation preventive layer formed with the same material as a light-transmitting region is adhered onto the rear surface side of the polishing region. A double sided tape or an adhesive is used in adhesion. However, neither the double sided tape nor the adhesive is provided in a portion where the aperture and the water permeation preventive layer. Thereafter, a light-transmitting region forming material is cast into the aperture to cure the material, to thereby, obtain the light-transmitting region and the water permeation preventive layer integrally formed in a single piece and to manufacture a polishing pad.

The polishing region and the water permeation preventive layer are preferably of the same size as each other. A construction is also preferably adopted that the water permeation preventive layer is smaller in size than the polishing region so that the polishing region covers the side surface of the water permeation preventive layer. In the later construction, a slurry can be prevented from intruding into the inside from the side surface during polishing with the result that separation between the polishing region and the water permeation preventive layer can be prevented.

A polishing pad of the invention may be a laminate polishing pad obtained by laminating a cushion layer on one surface of the water permeation preventive layer. If the water permeation preventive layer has no cushioning effect, a separate cushion layer is preferably provided.

The cushion layer compensates for characteristics of the polishing layer (polishing region). The cushion layer is required for satisfying both planarity and uniformity which are in a tradeoff relationship in chemical mechanical polishing (CMP). Planarity refers to flatness of a pattern region upon polishing an object of polishing having fine unevenness generated upon pattern formation, and uniformity refers to the uniformity of the whole of an object of polishing. Planarity is improved by the characteristics of the polishing layer, while uniformity is improved by the characteristics of the cushion layer. The cushion layer used in the polishing pad of the present invention is preferably softer than the polishing layer.

The material forming the cushion layer is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

Means for adhering the water permeation preventive layer to the cushion layer include: for example, a method in which a double sided tape is sandwiched between the water permeation preventive layer and the cushion layer, followed by pressing. It is preferable to form a through hole, in the same size as the light-transmitting region, in a cushion layer and a double sided tape both with such a low light transmittance that a detection precision for an endpoint is affected.

The double-coated tape has a general constitution wherein an adhesive layer is arranged on both sides of a base material such as a nonwoven fabric or a film. The composition of the adhesive layer includes, for example, a rubber-based adhesive and an acrylic adhesive. In consideration of the content of metallic ion, the acrylic adhesive is preferable because of a lower content of metallic ion. Because the water permeation preventive layer and the cushion layer can be different in composition, the composition of each adhesive layer of the double-coated tape can be different to make the adhesion of each layer suitable.

A double sided tape for adhering a polishing pad to a polishing platen may be provided on the other surface side of the water permeation preventive layer or the cushion layer from the polishing region. A method for adhering a double sided tape onto the water permeation layer or the cushion layer by pressing is exemplified as a means for adhering a double sided tape onto the water permeation layer or the cushion layer. Note that the double sided tape with such a low light transmittance that a detection precision for an endpoint is affected is also preferably used forming a through hole in the same size as the light-transmitting region therein.

As described above, the double-coated tape has a general constitution wherein an adhesive layer is arranged on both sides of a base material such as a nonwoven fabric or a film. In consideration of removal of the polishing pad after use from a platen, a film is preferably used as the base material in order to solve a residual tape. The composition of the adhesive layer is the same as described above.

Second and Third Inventions

A polishing pad of the invention has at least a polishing region, a light-transmitting region, a cushion layer and a water non-permeable elastic member.

A material used in the light-transmitting region is the raw materials similar to those of the first invention. The material used in the light-transmitting region is preferably a material used in a polishing region or a material analogous to a material used in the polishing region in physical properties. Especially preferable is a polyurethane resin controllable of light scattering due to dressing marks during polishing and high in wear resistance.

Raw materials for the polyurethane resin is the raw materials similar to those of the first invention. A ratio among an organic isocyanate, a polyol and a chain extender can be altered properly according to molecular weights and desired physical properties of a light-transmitting region produced therefrom. In order to adjust an Asker hardness D of a light-transmitting region so as to fall in the range of from 30 to 75 degrees, a ratio of a total number of functional groups in a polyol and a chain extender (hydroxyl groups+amino groups) to the number of isocyanate groups of an organic isocyanate is preferably in the range of 0.9 to 1.2 and more preferably in the range of from 0.95 to 1.05.

In order to adjust an Asker hardness D of the light-transmitting region so as to fall in the range of from 30 to 75 degrees, any of known plasticizer can be employed without placing a specific limitation thereon. Examples thereof include: phthalic acid diesters such as dimethyl phthalate, diethyl phthalate, dibutyl phthalate, di(2-ethylhexyl) phthalate, dinonyl phthalate and dilauryl phthalate; aliphatic dibasic acid esters such as dioctyl adipate, di(2-ethylhexyl) adipate, diisononyl adipate, dibutyl sebacate, dioctyl sebacate, dibutyl sebacate and di(2-ethylhexyl) sebacate; phosphoric acid triesters such as tricresyl phosphate, tri(2-ethylhexyl) phosphate and tri(2-chloropropyl)phosphate; glycol esters such as polyethylene glycol ester, ethylene glycol monobutyl ether acetate and diethylene glycol monobutyl ether acetate; and epoxy compounds such as epoxidized soybean oil and epoxy aliphatic acid ester. Among them, preferably used is a glycol ester-based plasticizer containing no active hydrogen from the viewpoint of compatibility with a polyurethane resin and a polishing slurry.

A plasticizer is preferably added into a polyurethane resin in the range of from 4 to 40 wt %. With a specific quantity of a plasticizer in the range added, an Asker hardness A of a light-transmitting region can be adjusted in the range with ease. A quantity of addition of a plasticizer is more preferably in the range of 7 to 25 wt % in a polyurethane resin.

The polyurethane resin can be produced in a similar method as that in the first invention.

The method of preparing the light-transmitting region is not particularly limited, and the light-transmitting region can be prepared according to methods known in the art. For example, a method wherein a block of polyurethane resin produced by the method described above is cut in a predetermined thickness by a slicer in a handsaw system or a planing system, a method that involves casting resin into a mold having a cavity of predetermined thickness and then curing the resin, a method of using coating techniques and sheet molding techniques, etc. are used.

The shape of the light-transmitting region is not particularly limited, but is preferably similar to the shape of the aperture A of the polishing region.

No specific limitation is placed on both of a thickness of a light-transmitting region and a dispersion of the thickness in values and a thickness thereof and the dispersion of the thickness in values are similar to those in the first invention.

No specific limitation is placed on both of a material of which a polishing region is made and a manufacturing method therefor and the material of which a polishing region is made and the manufacturing method therefor are similar to those in the first invention.

No specific limitation is placed on a material of a water non-permeable elastic member and any of materials may be employed as far as they can impart water resistance and elasticity and a hardness lower than a polishing region and a light-transmitting region, and examples thereof include: a rubber, a thermoplastic elastomer and a composition (a pressure-sensitive adhesive or an adhesive) containing a water non-permeable resin such as a reaction curable resin.

Rubbers include: natural rubber, silicone rubber, acrylic rubber, urethane rubber, butadiene rubber, chloroprene rubber, isoprene rubber, nitrile rubber, epichlorohydrin rubber, butyl rubber, fluororubber, acrylonitrile-butadiene rubber, ethylene-propylene rubber and styrene-butadiene rubber. Among them, preferably used are silicone rubber, acrylic rubber and urethane rubber from the viewpoint of adherence to materials of a polishing region, a light-transmitting region or a cushion layer.

Examples of the thermoplastic elastomer (TPE) include: a natural rubber-based TPE, a polyurethane-based TPE, a polyester-based TPE, a polyamide-based TPE, a fluororesin-based TPE, a polyolefin-based TPE, a polyvinyl chloride-based TPE, a styrene-based TPE, a styrene-butadiene-styrene block copolymer (SBS), a styrene-ethylene-butylene-styrene block copolymer (SEBS), a styrene-ethylene-propylene-styrene block copolymer (SEPS), a styrene-isoprene-styrene block copolymer (SIS) and the like.

A reaction curable resin is a resin of a thermoset type, a photo-curable type or a moisture curable type and examples thereof include: a silicone-based resin, an elastic epoxy resin, a (meth)acrylic-based resin, a urethane-based resin and the like. Among them, preferably used are a silicon-based resin, an elastic epoxy resin, and a urethane-based resin.

In order to adjust an elasticity and a hardness of a water non-permeable elastic member, a plasticizer or a crosslinking agent can also be properly added into a water non-permeable resin composition. Examples of the crosslinking agent include: a silane compound, a polyisocyanate compound, an epoxy compound, an aziridine compound, a melamine compound, a urea compound, an hydride, a polyamine and a carboxyl group containing polymer. In a case where a photo-curable resin is employed, a photo-polymerization initiator is preferably added thereinto. In addition to the components, various kinds of conventionally known additives can be added, such as a tackifier, an age resister, a filler and a catalyst.

No specific limitation is imposed on a method for manufacturing a polishing pad of the second invention and various kinds of methods therefor may be adopted and description will be given of a concrete example thereof below.

Figure 8:
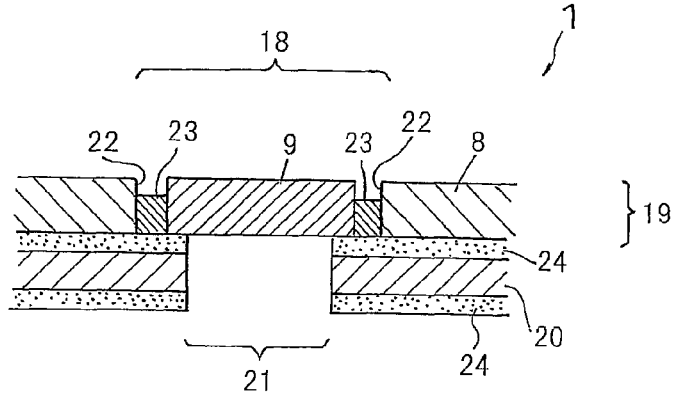
FIG. 8 is a schematic sectional view showing an example of a polishing pad of a second invention.

FIG. 8 is a schematic view of a structure showing examples of a polishing pad of the second invention.

In a first concrete example, a cushion layer 20 is adhered onto a polishing layer 19 having a polishing region 8, an aperture A (18) for providing a light-transmitting region 9. Then, part of the cushion layer in the aperture A is removed to form an aperture B (21) smaller in size than the light-transmitting region. Then, the light-transmitting region 9 is fittingly inserted into the aperture A on the aperture B. Thereafter, a water non-permeable resin composition is cast into an annular groove 22 residing in a clearance between the aperture A and the light-transmitting region to cure the composition by heating, irradiation with light or exposure to moisture and to thereby form a water non-permeable elastic member 23.

In a second concrete example, the polishing layer 19 having the polishing region 8, the aperture A (18) for providing the light-transmitting region 9, and the cushion layer 20 having the aperture B (21) smaller in size than the light-transmitting region are adhered to each other so as to superimpose the aperture A on the aperture B. Then, the light-transmitting region is fittingly inserted into the aperture A on the aperture B. Thereafter, a water non-permeable resin composition is cast into the annular groove 22 in a clearance between the aperture A and the light-transmitting region to heat the composition, irradiate the composition with light or expose the composition to moisture, to thereby cure the composition and to thereby form the water non-permeable elastic member 23.

In the methods for manufacturing a polishing pad, no specific limitation is placed on a means for boring the polishing region and the cushion layer, and, for example, a method for boring them by pressing a tool having a cutting ability, a method using a laser such as a carbon oxide gas laser and a method in which a work is cut by a tool such as a bite. Note that no specific limitation is placed on a size and shape of the aperture A.

Though no specific limitation is imposed on a width of an annular groove present between the aperture A and the light-transmitting region, a width thereof is preferably on the order in the range of from 0.5 to 3 mm and more preferably in the range of from 1 to 2 mm in consideration of casting the water non-permeable resin composition into the groove and a proportion in area of the light-transmitting region occupying in the polishing pad. If a groove width is less than 0.5 mm, it is difficult to cast the water non-permeable resin composition into the groove. Beside, since a strain or a dimensional change occurring in the light-transmitting region and a portion where the light-transmitting region is fittingly inserted cannot be sufficiently absorbed, the light-transmitting region protrudes or the polishing pad is deformed during polishing to create a tendency to deteriorate polishing characteristics such as in-plane uniformity. On the other hand, if a groove width exceeds 3 mm, a proportion which does not contribute to polishing during polishing unpreferably increases.

No specific limitation is placed on a method for manufacturing a polishing pad of the third invention and various kinds of practical methods therefor are available as ideas, description will be given of an concrete example below.

Figure 9:
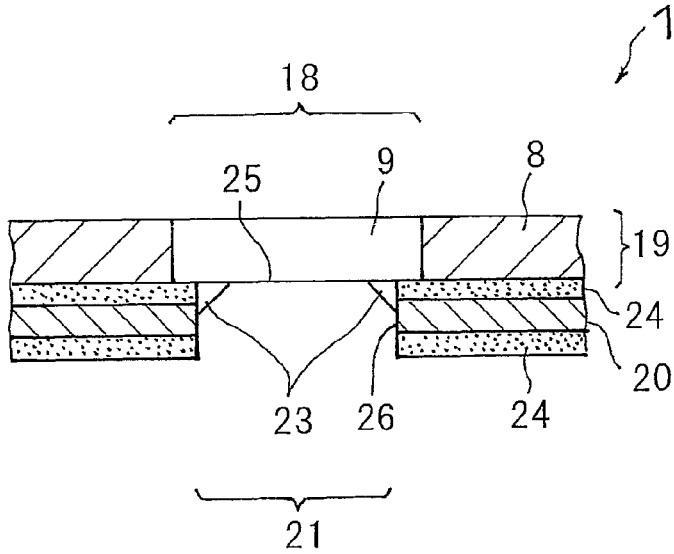
FIG. 9 is a schematic sectional view showing an example of a polishing pad of a third invention.

FIG. 9 is a schematic view of a structure showing examples of a polishing pad of the third invention.

In a first concrete example, a polishing layer 19 having a polishing region 8 and a light-transmitting region 9 and a cushion layer 20 having an aperture B (21) smaller in size than the light-transmitting region are adhered to each other so as to superimpose the light-transmitting region on the aperture B. Thereafter, the water non-permeable resin composition is coated over a contact portion between the rear surface 25 of the light-transmitting region and a section 26 of the aperture B to then heat the composition, irradiate the composition with light or expose the composition to moisture, to thereby cure the composition and to thereby form the annular water non-permeable elastic member 23 covering the contact portion.

In a second concrete example, a cushion layer 20 is adhered onto a polishing layer 19 having a polishing region 8 and an aperture A (18) for providing a light emissive region 8. Then, part of the cushion layer in the aperture A is removed to form an aperture B (21), smaller in size than the light-transmitting region, in the cushion layer. Then, the light-transmitting region is fittingly inserted into the aperture A on the aperture B. Thereafter, the water non-permeable resin composition is coated over a contact portion between the rear surface 25 of the light-transmitting region and a section 26 of the aperture B to then heat the composition, irradiate the composition with light or expose the composition to moisture, to thereby cure the composition and to thereby form the annular water non-permeable elastic member 23 covering the contact portion.

In a third concrete example, a polishing layer 19 having a polishing region 8 and an aperture A (18) for providing a light-transmitting region 9, and a cushion layer 20 having an aperture B (21) smaller in size than the light-transmitting region 9 are adhered onto each other so as superimpose the aperture A and the aperture B one on the other. Then, the light-transmitting region is fittingly inserted into the aperture A on the aperture B. Thereafter, a water non-permeable resin composition is coated over a contact portion between the rear surface 25 of the light-transmitting region and a section 26 of the aperture B to then heat the composition, irradiate the composition with light or expose the composition to moisture, to thereby cure the composition and to thereby form the annular water non-permeable elastic member 23 covering the contact portion.

In the methods for manufacturing a polishing pad, no specific limitation is placed on a means for boring the polishing region and the cushion layer, and, for example, a method for boring them by pressing a tool having a cutting ability, a method using a laser such as a carbon oxide gas laser and a method in which a work is cut by a tool such as a bite. Note that no specific limitation is placed on a size and shape of the aperture A.

Contact widths of the rear surface of the light-transmitting region and the section of the aperture B with the water non-permeable elastic member are preferably in the range of 0.1 to 3 mm and more preferably in the range of from 0.5 to 2 mm from the view point of an adhesive strength and an obstacle to optical detection of an endpoint. Note that no specific limitation is placed on a shape of a section of the water non-permeable elastic member.

In the second and third inventions, no specific limitation is placed on a material of or from which the cushion layer is made, which is similar in the first invention.

Means for adhering the polishing region to the cushion layer include: for example, a method in which a double sided tape 24 is sandwiched between the polishing region and the cushion layer, followed by pressing. The double sided tape 24 is similar to those in the first invention.

A double sided tape 24 for adhering a polishing pad to a polishing platen may be provided on the other surface side of the cushion layer from the polishing region. A method for adhering a double sided tape onto the cushion layer by pressing is exemplified as a means for adhering a double sided tape onto the cushion layer.

Fourth Invention

A polishing pad of the invention has a polishing region and a light-transmitting region.

A material of the light-transmitting region is necessary to be a material selected so that a compressibility of the light-transmitting region is more than that of the polishing region. No specific limitation is imposed on such a material and examples thereof include: a synthetic rubber, a polyurethane resin, a polyester resin, a polyamide resin, an acrylic resin, a polycarbonate resin, a halogen containing resin (polyvinyl chloride, polytetrafluoroethylene, polyvinylidene fluoride and the like) polystyrene, an olefin-based resin (polyethylene, polypropylene and the like) and an epoxy resin. The materials may be used either alone or in combination of two or more kinds. Note that it is preferably to, as a material of the light-transmitting region, use a material similar in physical properties to a material of which the polishing region is made or to the polishing region itself. Especially desirable are a synthetic rubber and a polyurethane resin capable of suppressing light scattering in the light-transmitting region caused by dressing marks during polishing and high in wear resistance.

Examples of the synthetic rubber include: acrylonitrile-butadiene rubber; isoprene rubber, butyl rubber, polybutadiene rubber, ethylene-propylene rubber, urethane rubber, styrene-butadiene rubber, chloroprene rubber, acrylic rubber, epichlorohydrin rubber and fluororubber. In order to obtain a light-transmitting region high in light transmittance, preferably used are acrylonitrile-butadiene rubber and/or polybutadiene rubber. Especially preferable is a crosslinked acrylonitrile-butadiene rubber.

Raw materials for the polyurethane resin is the raw materials similar to those of the first invention. The polyurethane resin can be produced in a similar method as that in the first invention.

The method of preparing the light-transmitting region is not particularly limited, and the light-transmitting region can be prepared according to methods known in the art. The shape of the light-transmitting region is not particularly limited, but is preferably similar to the shape of the aperture of the polishing region.

A thickness of a light-transmitting region of the invention is usually on the order in the range of from 0.5 to 4 mm and preferably in the range of from 0.6 to 3.5 mm. This is because a thickness of a light-transmitting region is preferably equal to or less than that of a polishing region. If a thickness of a light-transmitting region is excessively larger than that of a polishing region, there arises an unfavorable possibility for a wafer to be scratched by a protruded portion during polishing even if a compressibility of the light-transmitting region is larger than that of the polishing region. On the other hand, a thickness thereof is excessively smaller than that of the polishing region, durability is insufficient and there arises an adverse possibility to cause water leakage (slurry leakage).

A dispersion of the thickness in values of a light-transmitting region is similar to those in the first invention.

No specific limitation is placed on both of a material of which a polishing region is made and a manufacturing method therefor and the material of which a polishing region is made and the manufacturing method therefor are similar to those in the first invention.

No specific limitation is placed on a thickness of a polishing region, but a thickness thereof is preferably on the same order as a thickness of a light-transmitting region (on the order in the range of from 0.5 to 4 mm) and more preferably on the order in the range of from 0.6 to 3.5 mm. The method of preparing the polishing region of this thickness includes a method wherein a block of the fine-cell foam is cut in predetermined thickness by a slicer in a bandsaw system or a planing system, a method that involves casting resin into a mold having a cavity of predetermined thickness and curing the resin, a method of using coating techniques and sheet molding techniques, etc.

No specific limitation is placed on a method for manufacturing a polishing pad having a polishing region and a light-transmitting region, and various methods are practically available as ideas and description will be given of concrete examples below. Note that though polishing pads each with a cushion layer are described in the following examples, the methods may be applied to a polishing pad without a cushion layer.

Figure 10:
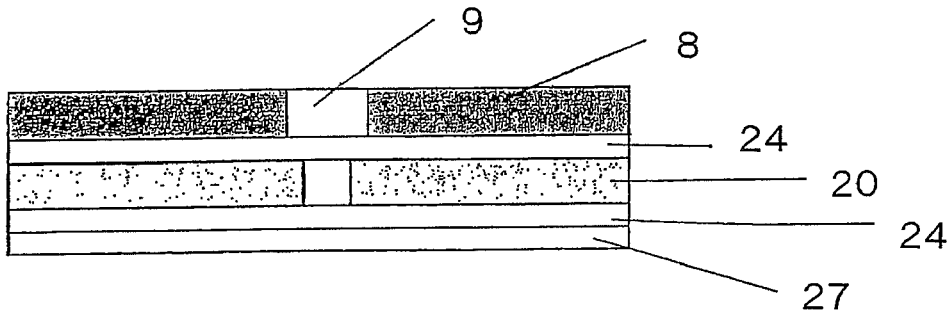
FIG. 10 is a schematic sectional view showing an example of a polishing pad of a third or fourth invention.

First of all, in a first example, as shown in FIG. 10, a polishing region 8 with an aperture with a predetermined size is adhered to a double sided tape 24, and a cushion layer 20 with an aperture with a predetermined size is adhered onto the lower surface of the both sided tape 24 so that the aperture of the cushion layer 20 coincides with the aperture of the polishing region 8. Then, a double sided tape 24 attached with a release paper 27 is adhered to the cushion layer 20 and the light-transmitting region 9 is fittingly inserted into the aperture of the polishing region 8 and adhered to the former double sided tape.

Figure 11:
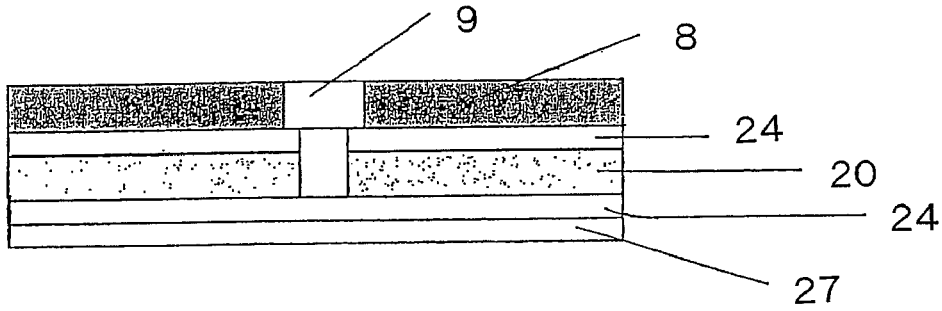
FIG. 11 is a schematic sectional view showing another example of the polishing pad of the third or fourth invention.

In a second concrete example, as shown in FIG. 11, a polishing region 8 with an aperture with a predetermined size is adhered onto a double sided tape 24 and a cushion layer 20 is adhered onto the lower surface of the double sided tape 24. Thereafter, the double sided tape 24 and the cushion layer 20 are bored so as to form an aperture with a predetermined size which coincides with the aperture of the polishing region 8. Then a double sided tape 24 attached with a release paper 27 is adhered onto the cushion layer 20 and a light-transmitting region 9 is fittingly inserted into the aperture of the polishing region 8 to thereby adhere the light-transmitting region 9 to the former double sided tape.

Figure 12:
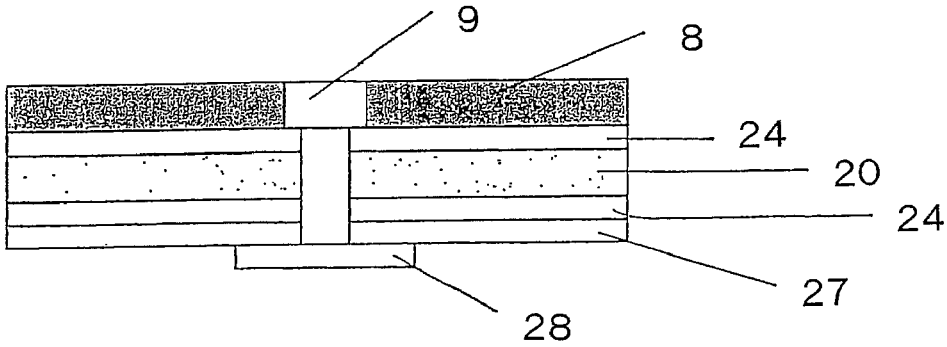
FIG. 12 is a schematic sectional view showing still another example of the polishing pad of a fourth or fifth invention.

In a third concrete example, as shown in FIG. 12, a polishing region 8 with an aperture with a predetermined size is adhered onto a double sided tape 24 and a cushion layer 20 is adhered onto the lower surface of the double sided tape 24. Then, a double sided tape 24 attached with a release paper 27 is adhered onto the other surface of the cushion layer 20 from the polishing region 8 and thereafter from the double sided tape 24 to the release paper 27 are bored so as to form an aperture with a predetermined size so as to coincide with the aperture of the polishing region 8. A light-transmitting region 9 is fittingly inserted into the aperture of the polishing region 8 to thereby adhere the light-transmitting region 9 to the former double sided tape. Note that in this case, since the other side of the light-transmitting region 9 from the front side thereof is open in the air and dust or the like is collected therein, a member 28 closing the aperture on the other side is preferably mounted.

Figure 13:
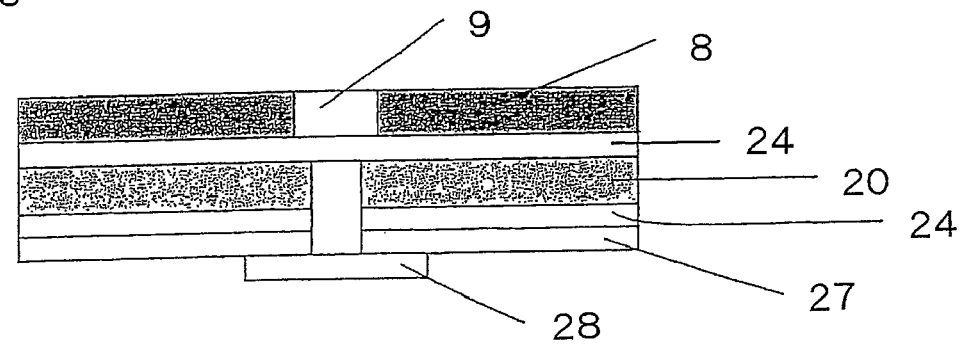
FIG. 13 is a schematic sectional view showing yet another example of the polishing pad of a fourth or fifth invention.
Figure 14:
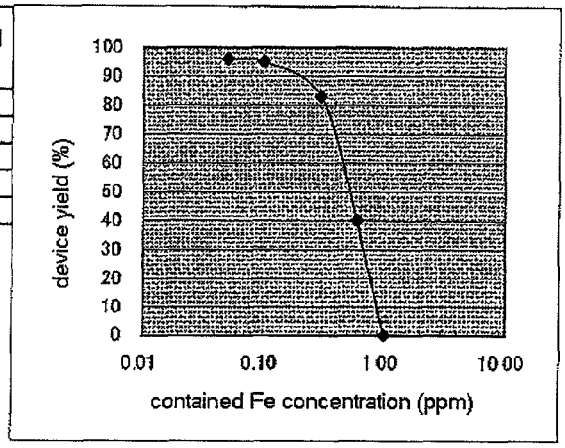
FIG. 14 is a graph showing a relationship of a Fe concentration and a device yield.
Figure 15:
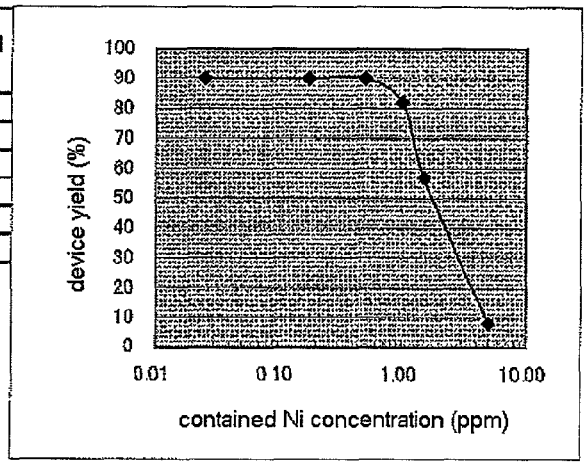
FIG. 15 is a graph showing a relationship of a Ni concentration and a device yield.
Figure 16:
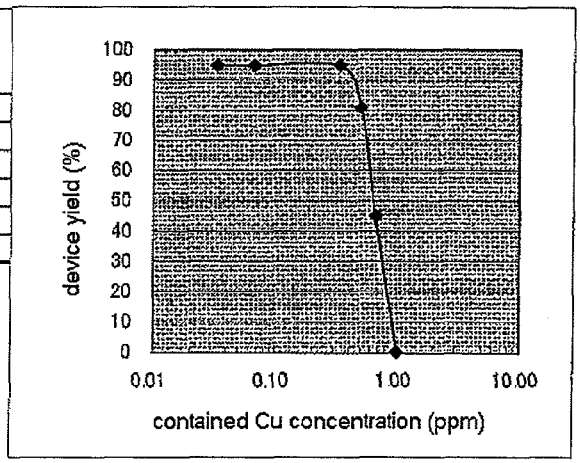
FIG. 16 is a graph showing a relationship of a Cu concentration and a device yield.
Figure 17:
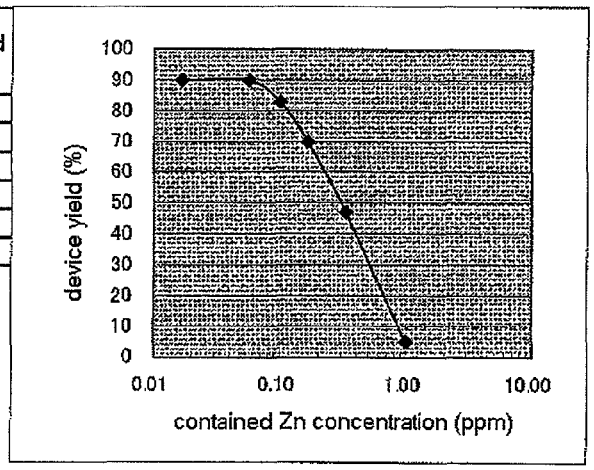
FIG. 17 is a graph showing a relationship of a Zn concentration and a device yield.
Figure 18:
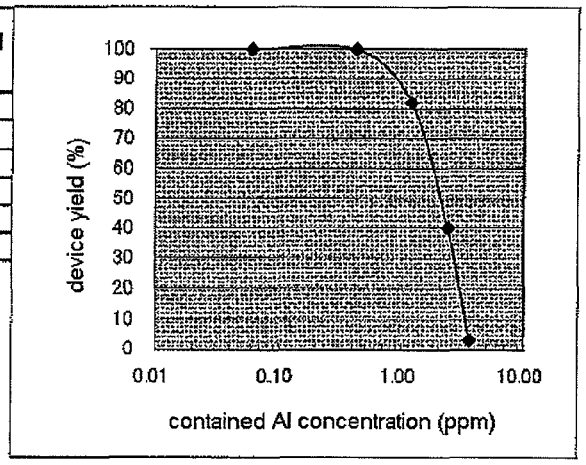
FIG. 18 is a graph showing a relationship of an Al concentration and a device yield.
Figure 19:
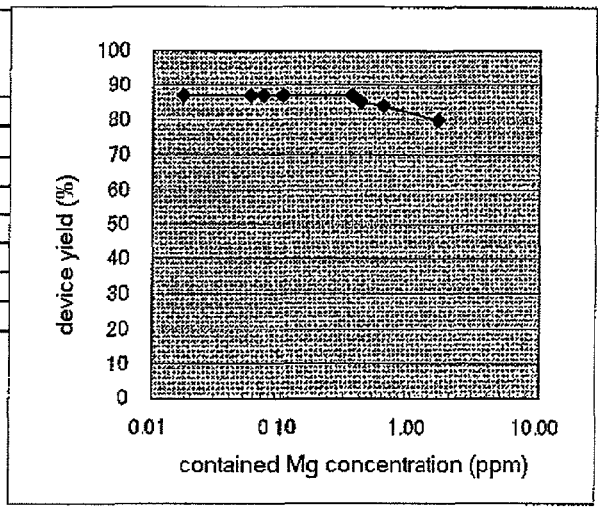
FIG. 19 is a graph showing a relationship of a Mg concentration and a device yield.
Figure 20:
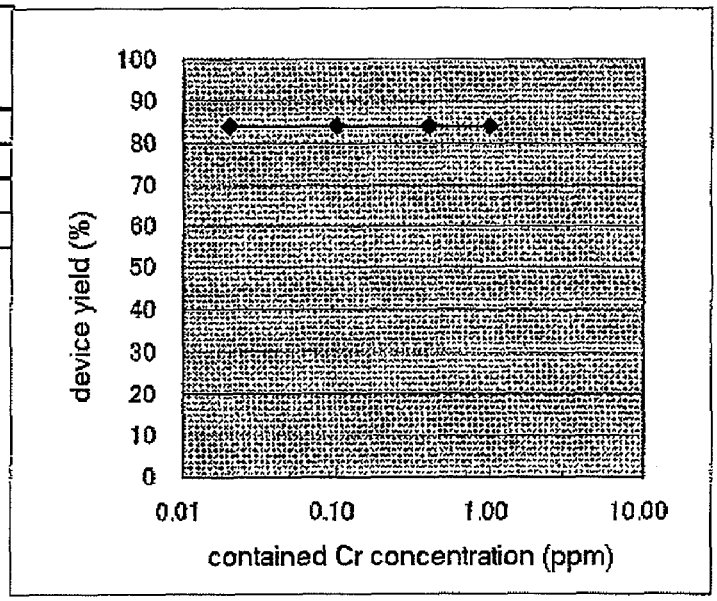
FIG. 20 is a graph showing a relationship of a Cr concentration and a device yield.
Figure 21:
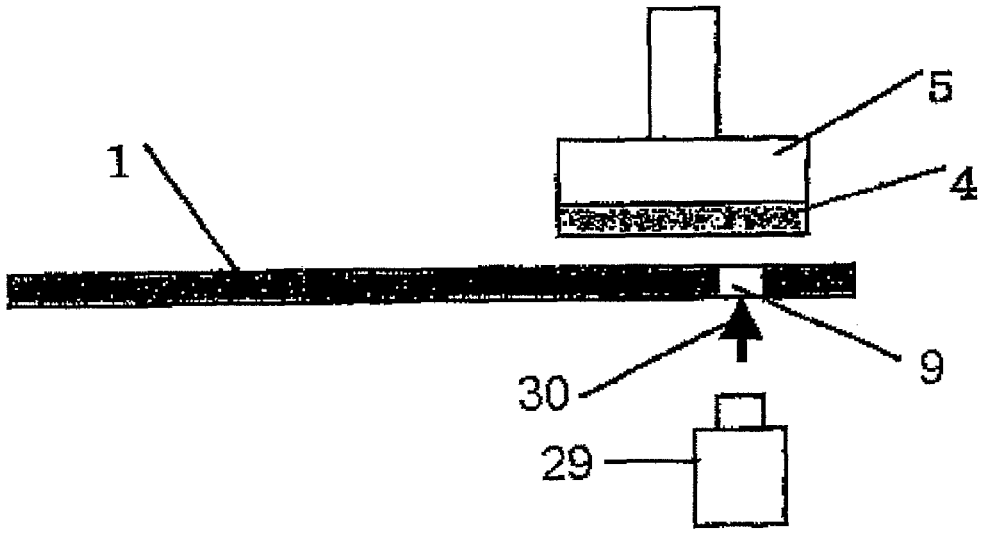
FIG. 21 is a schematic view of a construction showing an example of a CMP polishing apparatus having an endpoint detecting device of any of the first to fifth inventions.

In a fourth example, as shown in FIG. 13, a cushion layer 20 to which a double sided tape 24 attached with a release paper 27 is adhered is bored so as to form an aperture with a predetermined size. Then, a polishing region 8 bored so as to form an aperture with a predetermined size is adhered onto the double sided tape 24 so that both apertures coincide with each other. Thereafter, a light-transmitting region 9 is fittingly inserted into the aperture of the polishing region 8 to thereby adhere the light-transmitting region 9 to the latter double sided tape. Note that in this case, since the other side of the light-transmitting region 9 from the front side thereof is open in the air and dust or the like is collected therein, a member 28 closing the aperture on the other side is preferably mounted.

In the methods for manufacturing a polishing pad, no specific limitation is placed on a means for boring the polishing region and the cushion layer, and, for example, a method for boring them by pressing a tool having a cutting ability, a method using a laser such as a carbon oxide gas laser and a method in which a work is cut by a tool such as a bite. Note that no specific limitation is placed on a size and shape of the aperture of the polishing region.

No specific limitation is placed on materials of a cushion layer and a double sided tape and an adhering method, which is similar in the first invention.

No specific limitation is placed on the member 28 and any of members may be employed as far as they closes the aperture. However, the member 28 has to be peelable.

Fifth Invention

No specific limitation is imposed on materials of a polishing region and a light-transmitting region in the invention as far as the polishing region and light-transmitting region have a concentration of Fe of 0.3 ppm or less, a concentration of Ni of 1.0 ppm or less, a concentration of copper of 0.5 ppm or less, a concentration of zinc of 0.1 ppm or less and a concentration of Al of 1.2 ppm or less. In the invention, a material of the polishing region and the light-transmitting region is preferably a polymer of at least one kind selected from the group consisting of a polyolefin resin, a polyurethane resin, a (meth) acrylic resin, a silicone resin, a fluororesin, a polyester resin, a polyamide resin, a polyamideimide resin and a photosensitive resin.

Examples of a polyolefin resin include: polyethylene, polypropylene, polyvinyl chloride, a polyvinylidene chloride and the like.

Examples of a fluororesin include: polychlorotrifluoroethylene (PCTFE), perfluoroalcoxyalkane (PFA), polytetrafluoroethylene (PTFE), polyvinylidene fluoride (PVDF) and others.

Examples of a polyester resin include: polyethylene terephthalate, polybutylene terephthalate, polyethylene naphthalate and others.

Examples of the photosensitive resin include: photo-decomposition type photosensitive resin using photo-decomposition of a diazo group, an azido group or the like, a photo-dimerization type photosensitive resin using a photo-dimerization reaction of a functional group introduced into a side chain of a linear polymer, and a photo-polymerization type photosensitive resin using a photo-radical polymerization of an olefin, a photo-addition reaction of a thiol group to an olefin and a ring opening addition reaction of an epoxy group and the like.

In order to reduce a metal content in a polishing region and a light-transmitting region, it is preferable to decrease a metal content in raw materials used in synthesis of the resins.

It is thought, however, that even with reduction in metal content in a raw material, a metal content in the resin increases through contact of the resin with a metal during a production process thereof.

No specific limitation is imposed on a production method for each of the polymers and it can be produced by means of a known method, but, in the invention, the polymer is preferably produced using apparatuses or appliances each having no metal surface or a chrome plated surface in contact with a raw material and/or a reaction product therefrom through all the production process thereof. A production process for a polymer described above is different according to a kind of a polymer and for example, 1) in a case of a polyurethane resin, a production process thereof includes: a weighing step of a raw material, a filtration step, a mixing step, an agitation step, a casting step and the like, and 2) in a case where a photosensitive resin is produced, a production process thereof includes: a weighing step of a raw material, a mixing step, an extrusion step and the like. It is to preferably perform each of steps in the production process in a way such that a raw material and/or a reaction product therefrom is not brought into direct contact with a metal other than chrome. To be concrete, it is preferable to adopt a method in which a surface, brought into direct contact with a raw material and/or a reaction product therefrom, of each of apparatuses or appliances, such as a weighing vessel, a filter, a polymerization vessel, agitating blades, a casting vessel and an extrusion vessel, used in a production process for a polymer described above, is made of a material other than a metal or is chrome plated.

Examples of a surface of a material other than a metal include: surfaces of a resin and a ceramic, a surface of an appliance on which a non-metal coat is formed and the like. Examples of a non-metal coat include: a resin coat, a ceramic coat, a diamond coat and the like, on which no limitation is imposed.

No specific limitation is placed on a resin of which a coat is made and any of resins for coating excellent in anti-corrosion and extremely less in metal contamination may be adopted. A fluororesin is preferably used because of especially being excellent in anti-corrosion and extremely less in metal contamination. A concrete example of a fluororesin is PFA, PTFE and the like.

A polishing pad of the invention has a polishing region and a light-transmitting region.

A material of which a light-transmitting region is made has preferably a light transmittance of 10% or more in a measurement wavelength region of from 400 to 700 nm. If a light transmittance thereof is less than 10%, a tendency arises that a reflected light is weaker due to an influence of a slurry supplied during polishing or dressing marks to thereby reduce a detection precision of a film thickness or cause detection of a film thickness to be disabled. Desirable as a material thereof is a polyurethane resin capable of suppressing light scattering in the light-transmitting region due to dressing marks during polishing and excellent in wear resistance.

Raw materials for the polyurethane resin is the raw materials similar to those of the first invention.

A polymerization procedure for a polyurethane resin can be either a prepolymer method or a one shot method and preferable is the prepolymer method in which an isocyanate terminated prepolymer is synthesized from an organic isocyanate and a polyol in advance, followed by a reaction with a chain extender. In the prepolymer method, a polyurethane resin is produced with a polymerization vessel, agitation blades and a casting vessel each with a surface, brought into direct contact with the components and/or a reaction product thereof, is preferably made of a material other than a metal or chrome plated. Besides, it is preferable to use a weighing vessel, a filter and the like for a polyurethane raw material, each with a surface made of a material other than a metal or chrome plated. Besides, it is preferable to wash surfaces of the vessel and the like with an acid and an alkali extremely less in metal concentration therein.

Appliances or apparatuses used in production of a polymer such as a polyurethane are usually fabricated with metals from the viewpoint of a strength or the like. Especially, used from the viewpoint of anticorrosion or workability are iron, aluminum, copper, zinc-plated steel, stainless steel (a stainless steel is generally an alloy composed of Fe, Ni and Cr). Since the appliances or apparatuses are brought into direct contact with a raw material and a reaction product therefrom, a metal peeled off during production is mixed into a raw material or a reaction product therefrom. Since a mixing-in of a metal in such a way causes increase in a metal concentration in a raw material and a reaction product therefrom, a polymer is produced using appliances or apparatuses having surfaces brought into direct contact with a raw material and/or a reaction product therefrom and made of a material other than a metal or chrome plated.

The method of preparing the light-transmitting region is not particularly limited, and the light-transmitting region can be prepared according to methods known in the art. For example, a method wherein a block of polyurethane resin produced by the method described above is cut in a predetermined thickness by a slicer in a handsaw system or a planing system, a method that involves casting resin into a mold having a cavity of predetermined thickness and then curing the resin, a method of using coating techniques and sheet molding techniques, etc. are used. The tools such as a slicer or a metal mold is preferably prevented from exposing a metal thereof by diamond vapor deposition or the like. Alternatively, chrome plating is preferably used.

A material of which the light-transmitting region is made is preferably a non-foam. Since a non-foam can suppress scattering of light, a correct reflectance can be detected, thereby enabling an optical detection precision of an endpoint in polishing to be raised.

A polishing side surface of the light-transmitting region has preferably no depression and protrusion structure holding and renewing a polishing liquid. The term, a depression and protrusion structure, means a groove or a hole formed on a member surface by cutting or the like. If macroscopic surface depressions and protrusions exist on a polishing side surface of the light-transmitting region, a slurry containing additives such as abrasive grains is collected in depressions and scattering and absorption of light occur, which tends to affect detection precision. A surface of the water permeation protective layer has also preferably no macroscopic surface depressions and protrusions. If macroscopic surface depressions and protrusions exist, scattering of light is easy to occur, leading to an adverse possibility to exert an influence on detection precision.

Though no specific limitation is placed on a thickness of a light-transmitting region, it is preferably that a thickness thereof is equal to or less than that of a polishing region. If a thickness of a light-transmitting region is more than that of a polishing region, an adverse possibility arises that causes a scratch on a silicon wafer by the action of a protruded portion during polishing.

No specific limitation is imposed on a material of which a polishing region is made and a fabrication method, which is similar to that in the first invention. In the invention, however, it is necessary to use appliances or apparatuses having surfaces brought into direct contact with a raw material and/or a reaction product therefrom and made of a material other than a metal or chrome plated at least till completion of production of a polyurethane resin.

Though no specific limitation is placed on a thickness of a polishing region, a thickness thereof is generally in the range of from 0.8 to 2.0 mm. The following methods are employed as a method for fabricating a polishing region with such a thickness: a method in which a block of a polymer described above is cut to obtain a sheet with a predetermined thickness using a slicer of a band saw type or a planer type, a method in which a resin is cast into a mold with a cavity having a predetermined thickness, followed by curing the resin, a method in which using a coating technique or a sheet molding technique or the like. In a case of the slicer, it is necessary to adopt a step of grinding a blade edge in order to sustain a sharpness of the blade, in which case, the blade edge is preferably washed with ultra-pure water or a solvent having an extremely small metal content. Tools such as a mold preferably have no exposure of a metal by resin coating or diamond vapor deposition. Chrome plating of a surface thereof is preferable.

A polishing region is preferably provided with a depression and a protrusion structure for holding and renewing a slurry. Though in a case where the polishing region is formed with a fine foam, many openings are on a polishing surface thereof which works so as to hold the slurry, a depression and protrusion structure are preferably provided on the surface of the polishing side thereof in order to achieve more of holdability and renewal of the slurry or in order to prevent induction of dechuck error, breakage of a wafer or decrease in polishing efficiency.

The method of forming the depression and protrusion structure is not particularly limited, and for example, formation by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like. Tools such as a bite and a mold preferably have no exposure of a metal by diamond vapor deposition or the like. Chrome plating of a surface thereof is preferable.

The scatter of the thickness of the polishing region is preferably 100 μm or less, more preferably 50 μm or less. When the scatter of the thickness is higher than 100 μm, large undulation is caused to generate portions different in a contacting state with an object of polishing, thus adversely influencing polishing characteristics. To solve the scatter of the thickness of the polishing region, the surface of the polishing region is dressed generally in an initial stage of polishing by a dresser having abrasive grains of diamond deposited or fused thereon, but the polishing region outside of the range described above requires a longer dressing time to reduce the efficiency of production.

A method in which a surface of a polishing region obtained by slicing a block to a predetermined thickness is buffed is exemplified as a method for suppressing a dispersion of thickness values in the polishing region. In a case where buffing is adopted, a polishing belt, for example, over which abrasive grains are fixedly spread is used for the buffing, wherein preferable is a polishing belt less in metal content.

No specific limitation is placed on a method for manufacturing a polishing pad having a polishing region and a light-transmitting region and, for example, a method according to the fourth invention is exemplified as the method therefor.

A polishing pad according to any of the first to fifth inventions is used for planarization of depressions and protrusions on a surface of an object to be polished. Examples of the object to be polished include: optical materials such as a lens and a reflecting mirror; a silicon wafer used for a semiconductor device; a glass substrate for a plasma display and a hard disk; and a material to which high surface flatness is required such as a information recording resin board and an MEMS element. A polishing pad of the invention is effective for, especially, polishing a silicon wafer and a device on which an oxide layer, a metal layer, a low dielectric (low-k) layer, a high dielectric (high-k) layer and the like.

In a case where a surface of a semiconductor wafer used for a semiconductor device is polished, polished are an insulating layer and a metal layer formed on the semiconductor wafer. Examples of the insulating layer, which is made of a silicon oxide as a main stream, include: organic and inorganic materials each having a low dielectric constant, and a foam thereof having a lower dielectric constant, in connection with an issue of a delay time occurring from reduction in a distance between wires accompanying higher integration of a semiconductor circuit. Concrete examples of the insulating layer include: STI, an interlayer insulating film in a metal wiring section and the like. Examples of the metal layer include: a copper layer, an aluminum layer, a tungsten layer and others, which are formed as a plug, a dual Damascene multilevel interconnects and the like. In a case where a metal layer is employed, a barrier layer is provided thereto, which is also polished.

No specific limitation is placed on a slurry used in polishing and any suspension may be used as far as it polishes an object to be polished for planarization. In a case where a silicon wafer is polished, employed are aqueous suspension containing $SiO_2$, $CeO_2$, $Al_2O_3$, $ZrO_2$, $MnO_2$ and the like. An abrasive grain is altered according to a kind of an object to be polished. In a case where an object to be polished is a silicon oxide on a silicon wafer, an alkaline aqueous solution containing $SiO_2$ or a neutral aqueous solution containing $CeO_2$ is generally used. In a case where an object to be polished provided on a silicon wafer is made of a metal such as an aluminum, a tungsten, copper or the like, employed is an acidic aqueous solution that can oxidize the metal layers, into which abrasive grains are added. Since a metal layer is fragile and easy to suffer a damage called as a scratch, a case also arises where polishing is performed with an acidic aqueous solution containing no abrasive grain. Polishing may be performed while a surfactant is added in drops for the purposes to reduce a frictional resistance between a wafer and a polishing pad, to decrease scratches and to control a polishing velocity.

An enormous influence is exerted to a polishing quantity of an object to be polished by a pressure pressing the object to be polished against a polishing pad or a relative velocity of a polishing head on which the object to be polished is fixedly attached, relative to a polishing platen on which the polishing pad is fixedly adhered. The relative velocity and the pressure are different according to a kind of the object to be polished and a kind of a slurry and conditions for polishing are selected so as to render a polishing quantity and a flatness compatible with each other.

Since a polishing surface of a polishing pad is smoothed by an object to be polished to thereby degrade polishing characteristics, it is preferably to suppress an effect of smoothing a polishing pad. Examples of such a method include: a mechanical method such as dressing performed, at regular intervals, by a dresser on which diamond particles are electrodeposited, a chemical method such as chemical dissolution of a polishing surface and the like.

Figure 1:
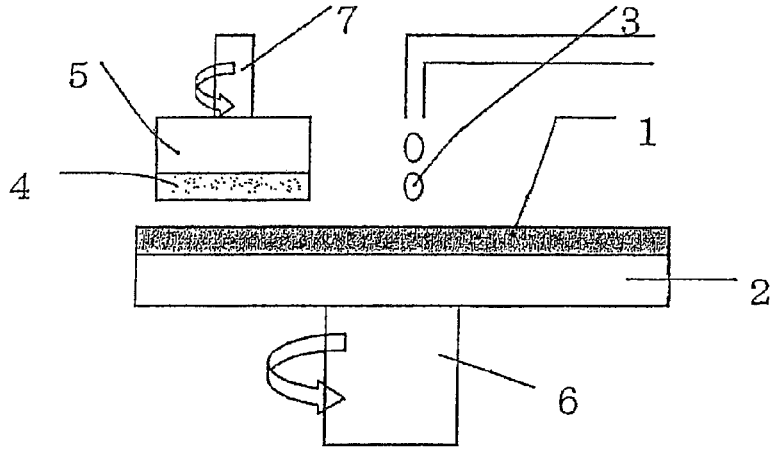
FIG. 1 is a schematic view of a construction showing an example of a polishing apparatus used in CMP polishing.
Figure 2:
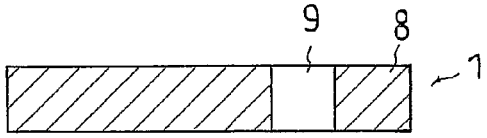
FIG. 2 is a schematic view of a structure showing an example of a conventional polishing pad.

The method of polishing a semiconductor wafer and a polishing apparatus are not particularly limited, and as shown in FIG. 1, polishing is conducted for example by using a polishing apparatus including a polishing platen 2 for supporting a polishing pad 1, a supporting stand (polishing head)

5 for supporting a semiconductor wafer 4, a backing material for uniformly pressurizing the wafer, and a mechanism of feeding an abrasive 3. The polishing pad 1 is fitted, for example via a double-coated tape, with the polishing platen 2. The polishing platen 2 and the supporting stand 5 are provided with rotating shafts 6 and 7 and arranged such that the polishing pad 1 and the semiconductor wafer 4, both of which are supported by them, are arranged to be opposite to each other. The supporting stand 5 is provided with a pressurizing mechanism for pushing the semiconductor wafer 4 against the polishing pad 1. For polishing, the polishing platen 2 and the supporting stand 5 are rotated and simultaneously the semiconductor wafer 4 is polished by pushing it against the polishing pad 1 with alkaline or acid slurry fed thereto.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Hereinafter, the Examples illustrating the constitution and effect of the first to Fifth inventions are described. Evaluation items in the Examples etc. were measured in the following manner.

(Measurement of Average Cell Diameter)

A polishing region cut parallel to be as thin as about 1 mm by a microtome cutter was used as a sample for measurement of average cell diameter. The sample was fixed on a slide glass, and the diameters of all cells in an arbitrary region of 0.2 mm×0.2 mm were determined by an image processor (Image Analyzer V10, manufactured by Toyobouseki Co., Ltd), to calculate the average cell diameter.

(Measurement of Specific Gravity)

Determined according to JIS Z8807-1976. A polishing region cut out in the form of a strip of 4 cm×8.5 cm (thickness: arbitrary) was used as a sample for measurement of specific gravity and left for 16 hours in an environment of a temperature of 23±2° C. and a humidity of 50%±5%. Measurement was conducted by using a specific gravity hydrometer (manufactured by Sartorius Co., Ltd).

(Measurement of Asker D or A Hardness)

Measurement is conducted according to JIS K6253-1997. A polishing region, a light-transmitting region, a foam layer or a water non-permeable elastic member cut out in a size of 2 cm×2 cm (thickness: arbitrary) was used as a sample for measurement of hardness and left for 16 hours in an environment of a temperature of 23±2° C. and a humidity of 50%±5%. At the time of measurement, samples were stuck on one another to a thickness of 6 mm or more. A hardness meter (Asker D or A hardness meter, manufactured by Kobunshi Keiki Co., Ltd.) was used to measure hardness.

(Measurement of Compressibility, Compression Recovery)

A polishing region cut into a circle of 7 mm in diameter (thickness: arbitrary) was used as a sample for measurement of compressibility and compression recovery and left for 40 hours in an environment of a temperature of 23±2° C. and a humidity of 50%±5%. In measurement, a thermal analysis measuring instrument TMA (SS6000, manufactured by SEIKO INSTRUMENTS Inc.) to measure compressibility and compression recovery. Equations for calculating compressibility and compression recovery are shown below. The compressibility and compression recovery of the light-transmitting region or the foam layer can be measured in a similar method as that in the above method.

$$\text{Compressibility}(\%)=\{(T1-T2)/T1\}\times 100$$

T1: the thickness of the polishing region after the polishing region in a non-loaded state is loaded with a stress of 30 kPa (300 g/cm$^2$) for 60 seconds.

T2: the thickness of the polishing region after the polishing region allowed to be in the T1 state is loaded with a stress of 180 kPa (1800 g/cm$^2$) for 60 seconds.

$$\text{Compression recovery}(\%)=\{(T3-T2)/(T1-T2)\}\times 100$$

T1: the thickness of the polishing region after the polishing region in a non-loaded state is loaded with a stress of 30 kPa (300 g/cm$^2$) for 60 seconds.

T2: the thickness of the polishing region after the polishing region allowed to be in the T1 state is loaded with a stress of 180 kPa (1800 g/cm$^2$) for 60 seconds.

T3: the thickness of the polishing region after the polishing region after allowed to be in the T2 state is kept without loading for 60 seconds and then loaded with a stress of 30 kPa (300 g/cm$^2$) for 60 seconds.

(Measurement of Storage Elastic Modulus)

Measurement is conducted according to JIS K7198-1991. A polishing region cut into a 3 mm×40 mm strip (thickness: arbitrary) was used as a sample for measurement of dynamic viscoelasticity and left for 4 days in a 23° C. environment condition in a container with silica gel. The accurate width and thickness of each sheet after cutting were measured using a micrometer. For measurement, a dynamic viscoelasticity spectrometer (manufactured by Iwamoto Seisakusho, now IS Giken) was used to determine storage elastic modulus E'. Measurement conditions are as follows:

<Measurement Conditions>

Measurement temperature: 40° C.
Applied strain: 0.03%
Initial loading: 20 g
Frequency: 1 Hz (Measurement of Light Transmittance)

The prepared light-transmitting region member was cut out with a size of 2 cm×6 cm (thickness: 1.25 mm) to prepare a sample for measurement of light transmittance. Using a spectrophotometer (U-3210 Spectro Photometer, manufactured by Hitachi, Ltd.), the sample was measured in the range of measurement wavelengths of 400 to 700 nm.

First Invention (Fabrication of Polishing Region)

Put into a reaction vessel were 1479 parts by wt of toluene diisocyanate (a mixture of toluene 2,4-diisocyanate/toluene 2,6-diiscyanate at a ratio of 80 to 20), 3930 parts by wt of 4,4'-dicyclohexylmethane diisocyanate, 25150 parts by wt of polytetramethylene glycol (number average molecular weight of 1006 and molecular weight spread of 1.7), 2756 parts by wt of diethylene glycol and the mixture was heat agitated at 80° C. for 120 min to obtain a prepolymer of isocyanate equivalent of 2.10 meq/g. Mixed in a reaction vessel were 100 parts by wt of the prepolymer and 3 parts by wt of a silicone-based nonionic surfactant (SH192, manufactured by Dow Corning Toray Silicone Co., Ltd.) and a temperature of the mixture was adjusted to 80° C. The mixture was vigorously agitated for about 4 min at a rotation number of 900 rpm with agitation blades so that bubbles are incorporated into the reaction system. Added into the reaction system was 26 parts by wt of 4,4'-methylenebis(o-chloroaniline) (IHARACUAMINE MT, manufactured by IHARA CHEMICAL INDUSTRY CO., LTD.) melted at 120° C. in advance. After the reaction system was continuously agitated for about 1 min, the reaction solution was cast into a pan type open mold. When the reaction solution lost fluidity, it was put into an oven and postcured at 110° C. for 6 hr to obtain a polyurethane resin foam block. The polyurethane resin foam block was sliced with a band saw type slicer (manufactured by Fecken-Kirfel) to obtain a polyurethane resin foam sheet. Then, the sheet was surface buffed to a predetermined thickness with a buffing machine (manufactured by AMITEC Corporation) to thereby obtain a sheet with an adjusted thickness precision (a sheet thickness of 1.27 mm). The buff-treated sheet was punched to form a disc with a predetermined diameter (61 cm) and recessing was applied on a surface of the disc using a recessing machine (manufactured by TohoKoki Co., Ltd.) to form concentric circular grooves each with a width of 0.25 mm and a depth of 0.40 mm at a groove pitch of 1.50 mm. Thereafter, an aperture (a thickness of 1.27 mm and a size of 57.5 mm×19.5 mm) for providing a light-transmitting region is punched at a predetermined position on the recessed sheet to thereby fabricate a polishing region. The fabricated polishing region had physical properties of an average bubble diameter of 45 μm, a specific gravity of 0.86, an Asker hardness D of 53 degrees, a compressibility of 1.0%, a compression recovery percentage of 65% and a storage modulus of 275 MPa).

Example 1

100 parts by wt of liquid urethane acrylate (Actilane 290, manufactured by AKCROS CHEMICALS CO.) and 1 part by wt of benzyldimethyl ketal were agitated with a planetary mixer (manufactured by THINKY Corporation) at a rotation number of 800 rpm for about 3 min to obtain a liquid photocurable resin composition. A release film was temporarily attached onto a surface of the fabricated polishing region and the polishing region was set in a mold frame. Thereafter, the photocurable resin composition was cast into a space section for forming an aperture and a water permeation preventive layer. A temperature of the mold frame is set to 40° C. Thereafter, the photocurable resin composition was cured by irradiation with ultraviolet to form a transparent member into which the light-transmitting region and the water permeation preventive layer are formed integrally as a single piece. The buffing machine was used to buff a surface of the water permeation preventive layer to adjust a thickness precision thereof. A thickness of the light-transmitting region was 1.27 mm and a thickness of the water permeation preventive layer was 25 μm. Thereafter, a double-sided tape (a double tack tape, manufactured by Sekisui Chemical Co., Ltd.) was adhered onto the surface of the water permeation preventive layer using a laminator to thereby manufacture a polishing pad. The light-transmitting region has physical properties of an Asker hardness A of 70 degrees, a compressibility of 3.9% and a compression recovery percentage of 96.8%.

Example 2

A polishing pad was manufactured by means of a similar method to that in Example 1 with the exception that a thickness of the water permeation preventive layer was set to 0.8 mm.

Example 3

A transparent member into which the light-transmitting region and the water permeation preventive layer were formed integrally as a single piece was fabricated by means of a similar method to that in Example 1. Thereafter, a double sided tape (a double tack tape, manufactured by Sekisui Chemical Co., Ltd.) was adhered to a surface of the water permeation preventive layer using a laminator. Then, the surface thereof was buffed and then, a cushion layer made of a corona-treated polyethylene foam (TORAYPEF with a thickness of 0.8 mm, manufactured by TORAY INDUSTRIES, INC.) was adhered onto the double sided tape. Then, a double sided tape was further adhered on a surface of the cushion layer. Thereafter, the double sided tapes and the cushion layer were removed in the area coinciding with the light-transmitting region in a size of 51 mm×13 mm to thereby manufacture a polishing pad.

Example 4

A transparent member into which a light-transmitting region and a water permeation preventive layer are formed integrally as a single piece was fabricated by means of a similar method to that in Example 1. Then, 100 parts by wt of the liquid urethane acrylate and 1 part by wt of benzyldimethyl ketal were vigorously agitated for about 4 min at a rotation number of 900 rpm with agitation blades so that bubbles are incorporated into the mixture to thereby obtain a photocurable resin composition in a state of a foam liquid. The photocurable resin composition was cast on the water permeation preventive layer while the light-transmitting region was covered with a fluororesin sheet so that the composition was not fed into the light-transmitting region. A temperature of a mold frame was set to 40 degrees. Thereafter, the photocurable resin composition was cured by irradiation with ultraviolet to form a foam layer (cushion layer). A surface of the foam layer was buffed with a buffing machine to adjust a thickness precision thereof. A thickness of the foam layer was 0.8 mm. Thereafter, a double sided tape (a double tack tape, manufactured by Sekisui Chemical Co., Ltd.) was adhered onto a surface of the foam layer to thereby manufacture a polishing pad. The foam layer has physical properties of an Asker hardness A of 68 degrees, a compressibility of 5.6% and a compression recovery percentage of 94.5%.

Example 5

A polishing pad was manufactured by means of a similar method to that in Example 1 with the exception that, in Example 1, 80 parts by wt of liquid urethane acrylate (Actilane 290, manufactured by Aczo Nobeles Co.), 20 parts by wt of liquid urethane acrylate (UA-101H, manufactured by Kyoeisha Chemical Co., Ltd.) were used instead of 100 parts by wt of liquid urethane acrylate (Actilane 290, manufactured by AKCROS CHEMICALS CO.). A light-transmitting region has physical properties of an Asker hardness A of 87 degrees, a compressibility of 1.3% and a compression recovery percentage of 94.3%.

Example 6

A polishing pad was manufactured by means of a similar method to that in Example 2 with the exception that, in Example 2, 80 parts by wt of liquid urethane acrylate (Actilane 290, manufactured by Aczo Nobeles Co.), 20 parts by wt of liquid urethane acrylate (UA-101H, manufactured by Kyoeisha Chemical Co., Ltd.) were used instead of 100 parts by wt of liquid urethane acrylate (Actilane 290, manufactured by AKCROS CHEMICALS CO.). A light-transmitting region has physical properties of an Asker hardness A of 87 degrees, a compressibility of 1.3% and a compression recovery percentage of 94.3%.

Example 7

A polishing pad was manufactured by means of a similar method to that in Example 3 with the exception that, in Example 3, 80 parts by wt of liquid urethane acrylate (Actilane 290, manufactured by Aczo Nobeles Co.), 20 parts by wt of liquid urethane acrylate (UA-101H, manufactured by Kyoeisha Chemical Co., Ltd.) were used instead of 100 parts by wt of liquid urethane acrylate (Actilane 290, manufactured by AKCROS CHEMICALS CO.). A light-transmitting region has physical properties of an Asker hardness A of 87 degrees, a compressibility of 1.3% and a compression recovery percentage of 94.3%.

Example 8

A polishing pad was manufactured by means of a similar method to that in Example 4 with the exception that, in Example 4, 80 parts by wt of liquid urethane acrylate (Actilane 290, manufactured by Aczo Nobeles Co.), 20 parts by wt of liquid urethane acrylate (UA-101H, manufactured by Kyoeisha Chemical Co., Ltd.) were used instead of 100 parts by wt of liquid urethane acrylate (Actilane 290, manufactured by AKCROS CHEMICALS CO.). A light-transmitting region has physical properties of an Asker hardness A of 87 degrees, a compressibility of 1.3% and a compression recovery percentage of 94.3%. The foam layer has physical properties of an Asker hardness A of 80 degrees, a compressibility of 3.4% and a compression recovery percentage of 93.1%.

Example 9

Put into a reaction vessel were 14790 parts by wt of toluene diisocyanate (a mixture of toluene 2,4-diisocyanate/toluene 2,6-diiscyanate at a ratio of 80 to 20), 3930 parts by wt of 4,4'-dicyclohexylmethane diisocyanate, 25150 parts by wt of polytetramethylene glycol (number average molecular weight of 1006 and molecular weight spread of 1.7), 2756 parts by wt of diethylene glycol and the mixture was heat agitated at 80° C. for 120 min to obtain an isocyanate-terminated prepolymer of isocyanate equivalent of 2.1 meq/g. 100 parts by wt of the prepolymer was weighed and put into a vacuum tank and a gas remaining in the prepolymer was defoamed under a reduced pressure (about 10 Torr). Added into the defoamed prepolymer was 29 parts by wt of 4,4'-methylenebis(o-chloroaniline) melted at 120° C. in advance and the mixture was agitated with a planetary mixer (manufactured by THINKY Corporation) at a rotation number of 800 rpm for about 3 min. A release film was temporarily attached onto a surface of the fabricated polishing region and the polishing region was set in a mold frame. Thereafter, the mixture was cast into a space section for forming an aperture and a water permeation preventive layer. A temperature of the mold frame at this time is set to 100° C. After vacuum defoaming of the cast mixture, the defoamed mixture was postcured in an oven at 110° C. for 9 hr to form a transparent member into which the light-transmitting region and the water permeation preventive layer are formed integrally as a single piece. The buffing machine was used to buff a surface of the water permeation preventive layer to adjust a thickness precision thereof. A thickness of the light-transmitting region was 1.27 mm and a thickness of the water permeation preventive layer was 25 μm. Thereafter, a double-sided tape (a double tack tape, manufactured by Sekisui Chemical Co., Ltd.) was adhered onto the surface of the water permeation preventive layer using a laminator to thereby manufacture a polishing pad. The light-transmitting region has physical properties of an Asker hardness A of 94 degrees, a compressibility of 0.9% and a compression recovery percentage of 73%.

Example 10

128 parts by wt of a polyesterpolyol synthesized from adipic acid, hexandiol and ethylene glycol (number average molecular weight 2050) and 30 parts by wt of 1,4-butanediol were mixed and a temperature of the mixture was controlled at 70° C. 100 parts by wt of 4,4'-diphenylmethane diisocyanate a temperature of which was adjusted at 70° C. in advance was added into the mixed liquid and thus obtained mixture was agitated with a planetary mixer (manufactured by THINKY Corporation) at a rotation number of 800 rpm for about 3 min. A release film was temporarily attached onto a surface of the fabricated polishing region and the polishing region was set in a mold frame. Thereafter, the mixture was cast into a space section for forming an aperture and a water permeation preventive layer. A temperature of the mold frame is set to 100° C. After vacuum defoaming of the cast mixture, the defoamed mixture was postcured in an oven at 100° C. for 8 hr to form a transparent member into which the light-transmitting region and the water permeation preventive layer are formed integrally as a single piece. The buffing machine was used to buff a surface of the water permeation preventive layer to adjust a thickness precision thereof. A thickness of the light-transmitting region was 1.27 mm and a thickness of the water permeation preventive layer was 25 μm. Thereafter, a double-sided tape (a double tack tape, manufactured by Sekisui Chemical Co., Ltd.) was adhered onto the surface of the water permeation preventive layer using a laminator to thereby manufacture a polishing pad. The light-transmitting region has physical properties of an Asker hardness A of 93 degrees, a compressibility of 1.1% and a compression recovery percentage of 87.9%.

Example 11

128 parts by wt of a polyesterpolyol synthesized from adipic acid, hexandiol and ethylene glycol (number average molecular weight 2050) and 30 parts by wt of 1,4-butanediol were mixed and a temperature of the mixture was controlled at 70° C. 100 parts by wt of 4,4'-diphenylmethane diisocyanate a temperature of which was adjusted at 70° C. in advance was added into the mixed liquid and thus obtained mixture was agitated with a planetary mixer (manufactured by THINKY Corporation) at a rotation number of 800 rpm for about 3 min to obtain a mixture. The mixture was cast into a mold (see FIG. 7) having shapes of a light-transmitting region and a water permeation preventive layer. A temperature of the mold is set to 100° C. After vacuum defoaming of the cast mixture, the defoamed mixture was postcured in an oven at 100° C. for 8 hr to form a transparent member into which the light-transmitting region and the water permeation preventive layer are formed integrally as a single piece. The buffing machine was used to buff a surface of the water permeation preventive layer to adjust a thickness precision thereof. A thickness of the light-transmitting region was 1.27 mm and a thickness of the water permeation preventive layer was 25 μm. An acrylic-based adhesive was coated on the polishing region side of the water permeation preventive layer to a uniform thickness and the water permeation preventive layer was adhered onto the fabricated polishing region. Thereafter, a double-sided tape (a double tack tape, manufactured by Sekisui Chemical Co., Ltd.) was adhered onto the surface of the water permeation preventive layer using a laminator to thereby manufacture a polishing pad. The light-transmitting region has physical properties of an Asker hardness A of 93 degrees, a compressibility of 1.1% and a compression recovery percentage of 87.9%.

Comparative Example 1

Put into a reaction vessel were 14790 parts by wt of toluene diisocyanate (a mixture of toluene 2,4-diisocyanate/toluene 2,6-diiscyanate at a ratio of 80 to 20), 3930 parts by wt of 4,4'-dicyclohexylmethane diisocyanate, 25150 parts by wt of polytetramethylene glycol (number average molecular weight of 1006 and molecular weight spread of 1.7), 2756 parts by wt of diethylene glycol and the mixture was heat agitated at 80° C. for 120 min to obtain an isocyanate terminated prepolymer (isocyanate equivalent of 2.1 meq/g). One hundred parts by wt of the prepolymer was weighed and put into a vacuum tank and a gas remaining in the prepolymer was defoamed under a reduced pressure (about 10 Torr). Added into the defoamed prepolymer was 29 parts by wt of 4,4'-methylenebis(o-chloroaniline) melted at 120° C. in advance and the mixture was agitated with a planetary mixer (manufactured by THINKY Corporation) at a rotation number of 800 rpm for about 3 min. The mixture was cast into a mold and after vacuum defoaming of the cast mixture, the defoamed mixture was postcured in an oven at 110° C. for 9 hr to obtain a polyurethane resin sheet. Thereafter, both surfaces of the polyurethane were buff polished to fabricate a light-transmitting region (with a size of 57 mm in length and 19 mm in width, and with a thickness of 1.25 mm). The light-transmitting region has physical properties of an Asker hardness A of 94 degrees, a compressibility of 0.9% and a compression recovery percentage of 73%.

A double sided tape (a double tack tape, manufactured by Sekisui Chemical Co., Ltd.) was adhered to a surface on the other side of the fabricated polishing region from the recessing surface using a laminator. Then, the surface thereof was buffed and then, a cushion layer made of a corona-treated polyethylene foam (TORAYPEF with a thickness of 0.8 mm, manufactured by TORAY INDUSTRIES, INC.) was adhered onto a pressure sensitive adhesive surface of the double sided tape using a laminator. Then, a double sided tape was further adhered on a surface of the cushion layer. Thereafter, within the aperture of the polishing region, the cushion layer and the double sided tape were punched in a size of 51 mm×13 mm to form a through hole. Thereafter, the fabricated light-transmitting region was fittingly inserted to manufacture a polishing pad.

(Evaluation of Water Leakage)

A polishing apparatus SPP600S (manufactured by Okamoto Machine Tool Works, Ltd.) and a fabricated polishing pad were used to conduct evaluation of water leakage. An 8 inch dummy wafer was polished and visual observation was conducted on whether or not water leakage occurs on the rear surface side of a light-transmitting region at predetermined intervals. In Table 1, there is shown a relationship between water leakage and a polishing time. Polishing conditions were such that a silica slurry (SS12, manufactured by Cabot Microelectronics Corporation) was added as an alkaline slurry during polishing at a flow rate of 150 ml/min, a polishing load was 350 g/cm$^2$, a rotation number of a polishing platen was 35 rpm and a rotation number of a wafer was 30 rpm. Wafer polishing was conducted while a surface of a polishing pad was dressed with a #100 dresser. Conditions for dressing were such that a dressing load 80 g/cm$^2$ and a rotation number of the dresser was 35 rpm.

TABLE 1

| | A relationship between water leakage and a polishing time |
|---|---|
| Example 1 | Water leakage was not seen even after 1800 min. |
| Example 2 | Water leakage was not seen even after 1800 min. |
| Example 3 | Water leakage was not seen even after 1800 min. |
| Example 4 | Water leakage was not seen even after 1800 min. |
| Example 5 | Water leakage was not seen even after 1800 min. |
| Example 6 | Water leakage was not seen even after 1800 min. |
| Example 7 | Water leakage was not seen even after 1800 min. |
| Example 8 | Water leakage was not seen even after 1800 min. |
| Example 9 | Water leakage was not seen even after 1800 min. |
| Example 10 | Water leakage was not seen even after 1800 min. |
| Example 11 | Water leakage was not seen even after 1800 min. |
| Comparative Example 1 | Water leakage occurred after 1400 min. |

As is clear from Table 1, with the polishing pad of the first invention adopted, a slurry leakage from between a polishing region and a light-transmitting region was prevented for a long time.

Second Invention (Fabrication of Light-Transmitting Region)

Mixed together were 128 parts by weight of polesterpolyol synthesized by adipic acid, hexanediol and ethylene glycol (number average molecular weight of 2400), 30 parts by wt of 1,4-butanediol and a temperature of the mixture was controlled at 70° C. Added into the mixture was 100 parts by wt of 4,4'-diphenylmethane diisocyanate a temperature of which was controlled at 70° C. in advance, followed by agitation for about 1 min. The mixed liquid was cast in a vessel kept at 100° C. and postcured at 100° C. for 8 hr to produce a polyurethane resin. The produced polyurethane resin was used to fabricate a light-transmitting region (with a size of 56 mm in length and 20 mm in width and with a thickness of 1.25 mm) with injection molding. An Asker hardness D of the fabricated light-transmitting region was 59 degrees.

(Fabrication of Polishing Region)

Fabrication Example 1

Mixed into a reaction vessel were 100 parts by wt of polyether-based prepolymer (Adiprene L-325, manufactured by Uniroyal Chemical Corporation, with an NCO concentration of 2.22 meq/g) and 3 parts by wt of a silicone-based nonionic surfactant (SH192, manufactured by Dow Corning Toray Silicone Co., Ltd.) and a temperature of the mixture was controlled at 80° C. The mixture was vigorously agitated at a rotation number of 900 rpm for about 4 min with agitation blades so that bubbles were incorporated into the reaction system. Added into the reaction system was 26 parts by wt of 4,4'-methylenebis(o-chloroaniline) (IHARACUAMINE MT, manufactured by IHARA CHEMICAL INDUSTRY CO., LTD.) melted at 120° C. in advance. Thereafter, the reaction system was continuously agitated for about 1 min and the reaction solution was cast into a pan type open mold. When the reaction solution lost fluidity, it was put into an oven and postcured at 110° C. for 6 hr to obtain a polyurethane resin foam block. The polyurethane resin foam block was sliced with a band saw type slicer (manufactured by Fecken-Kirfel) to obtain a polyurethane resin foam sheet. Then, the sheet was surface buffed to a predetermined thickness with a buffing machine (manufactured by AMITEC Corporation) to thereby obtain a sheet with an adjusted thickness precision (a sheet thickness of 1.27 mm). The buff-treated sheet was punched to form a disc with a predetermined diameter (61 cm) and recessing was applied on a surface of the disc using a recessing machine (manufactured by TohoKoki Co., Ltd.) to form concentric circular grooves each with a width of 0.25 mm and a depth of 0.40 mm at a groove pitch of 1.50 mm. A double sided tape (a double tack tape, manufactured by Sekisui Chemical Co., Ltd.) was adhered onto a surface on the other side of the sheet from the recessing surface with a laminator and thereafter, an aperture A (a size of 60 mm×24 mm) for fittingly inserting a light-transmitting region was punched at a predetermined position in the recessed sheet to thereby fabricate a polishing region attached with a double sided tape. The fabricated polishing region had physical properties of an average bubble diameter of 45 μm, a specific gravity of 0.86, an Asker hardness D of 53 degrees, a compressibility of 1.0%, a compression recovery percentage of 65.0% and a storage modulus of 275 MPa).

Fabrication Example 2

A polishing region attached with a double sided tape is fabricated by means of a similar method to that in Fabrication Example 1 with the exception that a size of an aperture A was set to 56 mm×20 mm.

(Manufacture of Polishing Pad)

Example 1

A cushion layer made of a corona-treated polyethylene foam (TORAYPEF with a thickness of 0.8 mm, manufactured by TORAY INDUSTRIES, INC.) and a surface of which was buffed was adhered onto a pressure sensitive adhesive surface of a polishing region attached with a double sided tape fabricated in Fabrication Example 1 with a laminator. Then, a double sided tape was adhered to a surface of the cushion layer. The cushion layer was punched so as to form a hole with a size of 50 mm×14 mm within a hole punched in order to fittingly insert a light-transmitting region to thereby form an aperture B. Then, a fabricated light-transmitting region was fittingly inserted into the aperture A (annular groove width of 2 mm). Thereafter, a silicone sealant (8060, manufactured by CEMEDINE Co., Ltd.) was cast into the annular groove so as to be higher by 1 mm above the polishing region and cured in that state to thereby form a water non-permeable elastic member (a height of 1 mm and an Asker hardness A of 27 degrees or an Asker hardness D of 4 degrees) and to manufacture a polishing pad.

Example 2

A polishing pad was manufactured by means of a similar method to that in Example 1 with the exception that in Example 1, a urethane-based sealant (S-700M, manufactured by CEMEDINE Co., Ltd.) was adopted instead of the silicon sealant. An Asker hardness A of the water non-permeable elastic member was 32 degrees (Asker hardness D of 7 degrees).

Example 3

A polishing pad was manufactured by means of a similar method to that in Example 1 with the exception that in Example 1, an elastic epoxy-based adhesive (PM210, manufactured by CEMEDINE Co., Ltd.) was used instead of the silicone sealant. An Asker hardness A of the water non-permeable elastic member was 58 degrees (Asker hardness D of 15 degrees).

Example 4

A polishing pad was manufactured by means of a similar method to that in Example 1 with the exception that in Example 1, a urethane-based sealing agent described below instead of the silicon sealant. An Asker hardness A of the water non-permeable elastic member was 55 degrees (Asker hardness D of 14 degrees).

The urethane-based sealing agent was prepared in a way such that an isocyanate prepolymer (L100, manufactured by Uniroyal Chemical Corporation) controlled at 80° C. and 4,4'-di-sec-butyl-diaminodiphenylmethane (Unilink 4200) controlled at 100° C. as a curing agent were mixed so that a molar ratio of isocyanate group/amino group was 1.05/1.0).

Example 5

A polishing pad was manufactured by means of a similar method to that in Example 1 with the exception that in Example 1, a photocurable resin composition was used instead of the silicone sealant and the resin composition was photocured by irradiation with ultraviolet. An Asker hardness A of the water non-permeable elastic member was 70 degrees (Asker hardness D of 26 degrees).

One hundred parts by wt of urethane acrylate (Actilane 290, manufactured by AKCROS CHEMICALS CO.) and 1 part by wt of benzyldimethyl ketal were agitated and mixed with a planetary mixer (manufactured by THINKY Corporation) at a rotation number of 800 rpm for about 3 min to obtain a liquid photocurable resin composition.

Comparative Example 1

A polishing pad was manufactured by means of a similar method to that in Example 1 with the exception that no water non-permeable elastic member was provided in an annular groove.

Comparative Example 2

A cushion layer made of a corona-treated polyethylene foam (TORAYPEF with a thickness of 0.8 mm, manufactured by TORAY INDUSTRIES, INC.) and a surface of which was buffed was adhered onto a pressure sensitive adhesive surface of a polishing region attached with a double sided tape fabricated in Fabrication Example 2 with a laminator. Then, a double sided tape was adhered onto a surface of the cushion layer. The cushion layer was punched so as to form a hole with a size of 50 mm×14 mm within a hole punched in order to fittingly insert a light-transmitting region in a polishing region to thereby form an aperture B. Then a fabricated light-transmitting region was fittingly inserted into the aperture A to manufacture a polishing pad. Note that since the light-transmitting region and the aperture A were the same size as each other, no clearance arises between the polishing region and the light-transmitting region.

Comparative Example 3

A polishing pad was manufactured by means of a similar method to that in Example 1 with the exception that in Example 1, a urethane-based sealing agent described below instead of the silicon sealant. An Asker hardness D of the water non-permeable elastic member was 75 degrees.

The urethane-based sealing agent was prepared in a way such that an isocyanate prepolymer (L325, manufactured by Uniroyal Chemical Corporation) controlled at 80° C. and 4,4'-methylenebis(o-chloroaniline) (IHARACUAMINE MT, manufactured by IHARA CHEMICAL INDUSTRY CO., LTD.) controlled at 120° C. as a curing agent were mixed so that a molar ratio of an isocyanate group/an amino group was 1.05/1.0).

(Evaluation of Water Leakage)

A polishing apparatus SPP600S (manufactured by Okamoto Machine Tool Works, Ltd.) and a fabricated polishing pad were used to conduct evaluation of water leakage. An 8 inch dummy wafer was continuously polished for 30 min and thereafter, visual observation was conducted on the inserted portion of a light-transmitting region on the rear surface side of the polishing pad and evaluation of water leakage was conducted with the following criteria. In Table 2, there are shown results of the evaluation. Polishing conditions were such that a silica slurry (SS12, manufactured by Cabot Microelectronics Corporation) was added as an alkaline slurry during polishing at a flow rate of 150 ml/min, a polishing load of 350 g/cm$^2$, a rotation number of a polishing platen was 35 rpm and rotation number of a wafer was 30 rpm. Wafer polishing was conducted while a surface of a polishing pad was dressed with a #100 dresser. Conditions for dressing were such that a dressing load 80 g/cm$^2$ and a rotation number of the dresser was 35 rpm.

O: no slurry leakage at the inserted portion is recognized x: slurry leakage at the inserted portion is recognized (Deformation Evaluation of Light-Transmitting Region)

A wafer was polished by means of a similar method to that as described above. Thereafter, a light-transmitting region was observed and deformation evaluation of the light-transmitting region was conducted with the following criteria. In Table 2, there are shown results of the evaluation. Note that with more of non-uniformity of dressing scratches in generation, a light-transmitting region is easier to be deformed during polishing.

O: dressing scratches generated on a light-transmitting region surface with uniformity X: dressing scratches generated on a light-transmitting region surface with non-uniformity

TABLE 2

| | Evaluation of water leakage | Evaluation of deformation |
|---|---|---|
| Example 1 | ○ | ○ |
| Example 2 | ○ | ○ |
| Example 3 | ○ | ○ |

TABLE 2-continued

| | Evaluation of water leakage | Evaluation of deformation |
|---|---|---|
| Example 4 | ○ | ○ |
| Example 5 | ○ | ○ |
| Comparative Example 1 | X | ○ |
| Comparative Example 2 | X | X |
| Comparative Example 3 | ○ | X |

As is clear from Table 2, by providing a water non-permeable elastic member smaller in hardness than a polishing region and a light-transmitting region in an annular groove between the polishing region and the light-transmitting region, a strain and a dimensional change generated in the light-transmitting region and the inserted portion thereof can be absorbed. Besides, since the water non-permeable elastic member can perfectly seal the contact portions between the polishing region, the light-transmitting region and the cushion layer, slurry leakage can be effectively prevented from occurring.

Third Invention (Fabrication of Light-Transmitting Region)

Mixed together were 128 parts by weight of polesterpolyol synthesized by adipic acid, hexanediol and ethylene glycol (number average molecular weight of 2400), 30 parts by wt of 1,4-butanediol and a temperature of the mixture was controlled at 70° C. Added into the mixture was 100 parts by wt of 4,4'-diphenylmethane diisocyanate a temperature of which was controlled at 70° C. in advance, followed by agitation for about 1 min. The mixed liquid was cast in a vessel kept at 100° C. and postcured at 100° C. for 8 hr to produce a polyurethane resin. The produced polyurethane resin was used to fabricate a light-transmitting region (with a size of 56.5 mm in length and 19.5 mm in width and with a thickness of 1.25 mm) with injection molding. An Asker hardness D of the fabricated light-transmitting region was 59 degrees.

(Fabrication of Polishing Region)

Mixed into a reaction vessel were 100 parts by wt of polyether-based prepolymer (Adiprene L-325, manufactured by Uniroyal Chemical Corporation, with an NCO concentration of 2.22 meq/g) and 3 parts by wt of a silicone-based nonionic surfactant (SH192, manufactured by Dow Corning Toray Silicone Co., Ltd.) and a temperature of the mixture was controlled at 80° C. The mixture was vigorously agitated at a rotation number of 900 rpm for about 4 min with agitation blades so that bubbles were incorporated into the reaction system. Added into the reaction system was 26 parts by wt of 4,4'-methylenebis(o-chloroaniline) (IHARACUAMINE MT, manufactured by IHARA CHEMICAL INDUSTRY CO., LTD.) melted at 120° C. in advance. Thereafter, the reaction system was continuously agitated for about 1 min and the reaction solution was cast into a pan type open mold. When the reaction solution lost fluidity, it was put into an oven and postcured at 110° C. for 6 hr to obtain a polyurethane resin foam block. The polyurethane resin foam block was sliced with a band saw type slicer (manufactured by Fecken-Kirfel) to obtain a polyurethane resin foam sheet. Then, the sheet was surface buffed to a predetermined thickness with a buffing machine (manufactured by AMITEC Corporation) to thereby obtain a sheet with an adjusted thickness precision (a sheet thickness of 1.27 mm). The buff-treated sheet was punched to form a disc with a predetermined diameter (61 cm) and recessing was applied on a surface of the disc using a recessing machine (manufactured by TohoKoki Co., Ltd.) to form concentric circular grooves each with a width of 0.25 mm and a depth of 0.40 mm at a groove pitch of 1.50 mm. A double sided tape (a double tack tape, manufactured by Sekisui Chemical Co., Ltd.) was adhered onto a surface on the other side of the sheet from the recessing surface with a laminator and thereafter, an aperture A (a size of 57 mm×20 mm) for fittingly inserting a light-transmitting region was punched at a predetermined position in the recessed sheet to thereby fabricate a polishing region attached with a double sided tape. The fabricated polishing region had physical properties of an average bubble diameter of 45 μm, a specific gravity of 0.86, an Asker hardness D of 53 degrees, a compressibility of 1.0%, a compression recovery percentage of 65.0% and a storage modulus of 275 MPa).

(Manufacture of Polishing Pad)

Example 1

A cushion layer made of a corona-treated polyethylene foam (TORAYPEF with a thickness of 0.8 mm, manufactured by TORAY INDUSTRIES, INC.) and a surface of which was buffed was adhered onto a pressure sensitive adhesive surface of a polishing region attached with a double sided tape. Then, a double sided tape was adhered to a surface of the cushion layer. The cushion layer was punched so as to form a hole with a size of 51 mm×14 mm within a hole punched in order to fittingly insert a light-transmitting region to thereby form an aperture B. Then, a fabricated light-transmitting region was fittingly inserted into the aperture A. Thereafter, by coating and curing a silicon sealant (8060, manufactured by CEMEDINE Co., Ltd.) over a contact portion between the rear surface of the light-transmitting region and the section of the aperture B, an annular water non-permeable elastic member (a contact width of 2 mm and an Asker hardness A of 27 degrees) was formed to thereby manufacture a polishing pad.

Example 2

A polishing pad was manufactured by means of a similar method to that in Example 1 with the exception that in Example 1, the following urethane-based sealing agent was employed instead of the silicone sealant. An Asker hardness A of the water non-permeable elastic member was 75 degrees.

The urethane-based sealing agent was prepared in a way such that an isocyanate prepolymer (Coronate 4076, manufactured by NIPPON POLYURETHANE INDUSTRY CO., LTD.) controlled at 80° C. and 4,4'-methylenebis(o-chloroaniline) (IHARACUAMINE MT, manufactured by IHARA CHEMICAL INDUSTRY CO., LTD.) controlled at 120° C. as a curing agent were mixed so that a molar ratio of an isocyanate group/an amino group was 1.05/1.0).

Example 3

A polishing pad was manufactured by means of a similar method to that in Example 1 with the exception that in Example 1, a urethane-based sealing agent (S-700M, manufactured by CEMEDINE Co., Ltd.) was used instead of the silicon sealant. An Asker hardness A of the water non-permeable elastic member was 32 degrees.

Example 4

A polishing pad was manufactured by means of a similar method to that in Example 1 with the exception that in Example 1, an epoxy-modified silicone elastic adhesive (EP-001, manufactured by CEMEDINE Co., Ltd.) was used instead of the silicone sealant. An Asker hardness A of the water non-permeable elastic member was 77 degrees.

Reference Example 1

A polishing pad was manufactured by means of a similar method to that in Example 1 with the exception that in Example 1, the following urethane-based sealing agent was employed instead of the silicone sealant. An Asker hardness A of the water non-permeable elastic member was 95 degrees.

The urethane-based sealing agent was prepared in a way such that an isocyanate prepolymer (Coronate 4096, manufactured by NIPPON POLYURETHANE INDUSTRY CO., LTD.) controlled at 80° C. and 4,4'-methylenebis(o-chloroaniline) (IHARACUAMINE MT, manufactured by IHARA CHEMICAL INDUSTRY CO., LTD.) controlled at 120° C. as a curing agent were mixed so that a molar ratio of an isocyanate group/an amino group was 1.05/1.0).

Comparative Example 1

A polishing pad was manufactured by means of a similar method to that in Example 1 with the exception that no water non-permeable elastic member was provided.

(Evaluation of Water Leakage)

A polishing apparatus SPP600S (manufactured by Okamoto Machine Tool Works, Ltd.) and a fabricated polishing pad were used to conduct evaluation of water leakage. An 8 inch dummy wafer was continuously polished for 30 min and thereafter, visual observation was conducted on the inserted portion of a light-transmitting region on the rear surface side of the polishing pad and evaluation of water leakage was conducted with the following criteria. The above operation was repeated till a polishing time reaches 420 min in total and water leakage was evaluated by a similar method to that as described above. In Table 3, there are shown results of the evaluation. Polishing conditions were such that a silica slurry (SS12, manufactured by Cabot Microelectronics Corporation) was added as an alkaline slurry during polishing at a flow rate of 150 ml/min, a polishing load of 350 g/cm$^2$, a rotation number of a polishing platen was 35 rpm and rotation number of a wafer was 30 rpm. Wafer polishing was conducted while a surface of a polishing pad was dressed with a #100 dresser. Conditions for dressing were such that a dressing load 80 g/cm$^2$ and a rotation number of the dresser was 35 rpm.

O: no slurry leakage at the inserted portion is recognized x: slurry leakage at the inserted portion is recognized

TABLE 3

| | Evaluation of water leakage | | | | | | | | | | | | | |
|---|---|---|---|---|---|---|---|---|---|---|---|---|---|---|
| | 30 min. | 60 min. | 90 min. | 120 min. | 150 min. | 180 min. | 210 min. | 240 min. | 270 min. | 300 min. | 330 min. | 360 min. | 390 min. | 420 min. |
| Example 1 | ○ | ○ | ○ | ○ | ○ | ○ | ○ | ○ | ○ | ○ | ○ | ○ | ○ | ○ |
| Example 2 | ○ | ○ | ○ | ○ | ○ | ○ | ○ | ○ | ○ | ○ | ○ | ○ | ○ | ○ |
| Example 3 | ○ | ○ | ○ | ○ | ○ | ○ | ○ | ○ | ○ | ○ | ○ | ○ | ○ | ○ |
| Example 4 | ○ | ○ | ○ | ○ | ○ | ○ | ○ | ○ | ○ | ○ | ○ | ○ | ○ | ○ |
| Reference Example 1 | ○ | ○ | ○ | ○ | ○ | ○ | ○ | ○ | ○ | ○ | ○ | ○ | X | — |
| Comparative Example 1 | ○ | ○ | ○ | ○ | ○ | ○ | ○ | ○ | X | — | — | — | — | — |

As is clear from Table 3, by providing an annular water non-permeable elastic member covering a contact portion over a contact portion between the rear surface of a light-transmitting region and the section of an aperture B, slurry leakage can be effectively prevented.

Fourth Invention

Fabrication Example 1

(Fabrication of Polishing Region)

Mixed together in a fluororesin-coated reaction vessel were 100 parts by wt of a filtered polyether-based prepolymer (Adiprene L-325, manufactured by Uniroyal Chemical Corporation, with an NCO concentration of 2.22 meq/g) and 3 parts by wt of a filtered silicone-based nonionic surfactant (SH192, manufactured by Dow Corning Toray Silicone Co., Ltd.) and a temperature of the mixture was controlled at 80° C. The mixture was vigorously agitated for about 4 min at a rotation number of 900 rpm with fluororesin-coated agitation blades so that bubbles are incorporated into the reaction system. Added into the reaction system was 26 parts by wt of filtered 4,4'-methylenebis(o-chloroaniline) (IHARACUAMINE MT, manufactured by IHARA CHEMICAL INDUSTRY CO., LTD.) melted at 120° C. in advance. Thereafter, the reaction solution was continuously agitated for about 1 min and cast into a fluororesin-coated pan type open mold. When the reaction solution lost fluidity, it was put into an oven and postcured at 110° C. for 6 hr to obtain a polyurethane resin foam block. The polyurethane resin foam block was sliced with a band saw type slicer (manufactured by Fecken-Kirfel) to obtain a polyurethane resin foam sheet. Then, the sheet was surface buffed to a predetermined thickness with a buffing machine (manufactured by AMITEC Corporation) to thereby obtain a sheet with an adjusted thickness precision (a sheet thickness of 1.27 mm). The buff-treated sheet was punched to form a disc with a predetermined diameter (61 cm) and recessing was applied on a surface of the disc using a recessing machine (manufactured by TohoKoki Co., Ltd.) to form concentric circular grooves each with a width of 0.25 mm and a depth of 0.40 mm at a groove pitch of 1.50 mm. A double sided tape (a double tack tape, manufactured by Sekisui Chemical Co., Ltd.) was adhered onto a surface on the other side of the sheet from the recessing surface using a laminator and thereafter, an aperture (a thickness of 1.27 mm and a size of 57.5 mm×19.5 mm) for fittingly inserting a light-transmitting region was punched at a predetermined position on the recessed sheet to thereby fabricate a polishing region attached with a double sided tape. The fabricated polishing region had physical properties of an average bubble diameter of 45 μm, a specific gravity of 0.86, an Asker hardness D of 53 degrees, an Asker hardness A of 95 degrees, a compressibility of 1.0%, a compression recovery percentage of 65% and a storage modulus of 275 MPa).

Example 1

(Manufacture of Polishing Pad)

A cushion layer made of a corona-treated polyethylene foam (TORAYPEF with a thickness of 0.8 mm, manufactured by TORAY INDUSTRIES, INC.) and a surface of which was buffed was adhered onto a pressure sensitive adhesive surface of a polishing region attached with a double sided tape fabricated as described above with a laminator. A double sided tape was further adhered onto a surface of a cushion layer. Thereafter, the cushion layer was punched so as to form a hole with a size of 51 mm×13 mm within a hole punched in order to fittingly insert a light-transmitting region in the polishing region.

Thereafter, a flexographic plate NS (manufactured by TOYOBO CO., LTD.) made from acrylonitrile butadiene rubber and polybutadiene rubber was perfectly exposed to ultraviolet with a UV exposure device was used as the light-transmitting region (with a size of 57 mm in length and 19 mm in width, and with a thickness of 1.25 mm). A compressibility of the light-transmitting region was 2.5% and an Asker hardness A was 61 degrees. The light-transmitting region was fittingly inserted in the hole for insertion to manufacture a polishing pad. Light transmittance were 26.4% at a wavelength of 400 nm, 84.5% at a wavelength of 500 nm, 88.3% at a wavelength of 600 nm and 88.7% at a wavelength of 700 nm.

Comparative Example 1

(Manufacture of Polishing Pad)

A polyurethane resin non-foam sheet was obtained by means of a similar method to that in Manufacture Example 1 with the exception that the silicone-based nonionic surfactant was not used and no bubble was incorporated in a reaction system. A light-transmitting region (with a size of 57 mm in length and 19 mm in width, and with a thickness of 1.25 mm) was obtained by cutting the polyurethane resin sheet. A compressibility of the light-transmitting region was 0.5% and an Asker hardness A was 95 degrees. The light-transmitting region was fittingly inserted into the hole for insertion to thereby manufacture a polishing pad. Light transmittance were 21.2% at a wavelength of 400 nm, 64.4% at a wavelength of 500 nm, 73.5% at a wavelength of 600 nm and 76.8% at a wavelength of 700 nm.

(Evaluation of Polishing Characteristic)

A polishing apparatus SPP600S (manufactured by Okamoto Machine Tool Works, Ltd.) and a fabricated polishing pad were used to evaluate polishing characteristics. In Table 4, there are shown results of evaluation on a polishing velocity and an in-plane uniformity. A polishing velocity was calculated from a time in which an 8 in silicon wafer on which a thermal oxide film was formed to 1 μm was polished off by about 0.5 μm. Measurement of a film thickness of an oxide film was conducted with a interference film thickness measuring instrument (manufactured by Otsuka Electronics Co., Ltd.). As a polishing condition, a silica slurry (SS12, manufactured by Cabot Microelectronics Corporation) as a polishing slurry was added at a flow rate of 150 ml/min during polishing. Other polishing conditions were set such that a polishing load was 350 g/cm$^2$, a rotation number of a polishing platen was 35 rpm and a wafer rotation number was 30 rpm.

An in-plane uniformity was calculated from measured film thickness values at 25 points arbitrarily selected on a wafer using the following formula. Note that decrease in in-plane uniformity value shows a higher uniformity on a wafer surface.

In-plane uniformity(%)={(maximum film thickness value−minimum film thickness value)/(maximum film thickness value+minimum film thickness value)}×100

(Measurement of Number of Scratches)

A polishing apparatus SPP600S (manufactured by Okamoto Machine Tool Works, Ltd.) and a fabricated polishing pad were used to polish an 8 in silicon wafer on which a thermal oxide film is formed to 1 μm was polished off by about 0.5 μm. As a polishing condition, a silica slurry (SS12, manufactured by Cabot Microelectronics Corporation) as a polishing slurry was added at a flow rate of 150 ml/min during polishing. Other polishing conditions were set such that a polishing load was 350 g/cm$^2$, a rotation number of a polishing platen was 35 rpm and a wafer rotation number was 30 rpm. After polishing, the number of streaks with 0.2 μm or more in width on the wafer was counted with a wafer surface inspecting apparatus (WM2500) manufactured by TOPCON CORP. In Table 4, there are shown results of the measurement.

(Evaluation of Thickness Detection)

An optical detection evaluation of a film thickness was conducted in the following procedure. An 8 in silicon wafer on which a thermal oxide film is formed to 1 μm was used for evaluation and the 8 in silicon wafer was placed on a polishing pad on which 1000 silicon wafer had been polished according to the above method. Film thickness measurement was conducted in several rimes with a interference film thickness measuring instrument (manufactured by Otsuka Electronics Co., Ltd.) at wavelengths in the wavelength region of from 500 to 700 nm. Confirmation was conducted on calculated results of film thickness and on a state of a peak and a valley of interference light, and evaluation was conducted on the film thickness detection with the following criteria. In Table 4, there are shown results of the evaluation. Note that more of scratches in a light-transmitting region is thought that reproducibility of film thickness detection is worsened.

O: a film thickness is measured with good reproducibility x: reproducibility is poor with insufficient detection precision

TABLE 4

| | Compressibility (%) | | Polishing | In-plane | | Evaluation of |
|---|---|---|---|---|---|---|
| | Polishing region | Light-transmitting region | velocity (Å/min.) | uniformity (%) | Scratch (number) | thickness detection |
| Example 1 | 1 | 2.5 | 2200 | 5.1 | 15 | ○ |
| Comparative Example 1 | 1 | 0.5 | 2180 | 8.9 | 89 | X |

As is clear from Table 4 that by employing a polishing pad with a compressibility of a light-transmitting region larger than that of a polishing region, a protrusion of the light-transmitting region from a polishing pad surface during polishing can be prevented from occurring, which makes it possible to suppress deterioration in polishing characteristics (in-plane uniformity and the like) and generation of scratches on a wafer.

Fifth Invention

Example 1

(Fabrication of Light-Transmitting Region)

Weighed with a fluororesin-coated weighing vessel were 128 parts by wt of a polyesterpolyol synthesized from adipic acid, hexanediol and ethylene glycol (number average molecular weight of 2400) and 30 parts by wt of 1,4-butanediol and the components were mixed in a fluororesin-coated polymerization vessel and then a temperature of the mixture was controlled at 70° C. Added into the mixture was 100 parts by wt of 4,4'-diphenylmethane diisocyanate controlled at 70° C. in advance and thus obtained mixture was agitated for about 1 min with a fluororesin-coated agitation blades. The agitated mixture was kept at 100° C. and cast into a chrome plated mold and postcured at 100° C. for 8 hr to thereby produce polyurethane. The produced polyurethane was used to fabricate a light-transmitting region (with a size of 56.5 mm in length and 19.5 mm in width, and with a thickness of 1.25 mm) using a chrome plated mold according to injection molding. In all the steps thus far, production or fabrication were conducted using appliances or apparatuses with fluororesin-coated or chrome plated surfaces in direct contact with a raw material or the like.

(Fabrication of Polishing Region)

Weighed with a fluororesin-coated weighing vessel were 3000 parts by wt of polyether-based prepolymer (Adiprene L-325, manufactured by Uniroyal Chemical Corporation, with an isocyanate concentration of 2.22 meq/g) and 90 parts by wt of a silicone-based nonionic surfactant (SH192, manufactured by Dow Corning Toray Silicone Co., Ltd.), then, the weighed components was mixed in a fluororesin-coated polymerization vessel and a temperature thereof is controlled at 80° C. Thus obtained mixture was vigorously agitated at a number of rotation of 900 rpm for about 4 min with a fluororesin-coated agitation blades so that bubbles were incorporated into the reaction system. Then, weighted with a fluororesin-coated weighing vessel and added into the polymerization vessel was 780 parts by wt of 4,4'-methylenebis(o-chloroaniline) (IHARACUAMINE MT, manufactured by IHARA CHEMICAL INDUSTRY CO., LTD.) melted at 120° C. in advance. After about 4 min of agitation, the reaction solution was cast in a fluororesin-coated mold. When the reaction solution lost fluidity, it was put into an oven with a nichrome heating wire section in a separate chamber and postcured at 110° C. for 6 hr to thereby produce polyurethane foam block. In all the steps thus far, production or fabrication were conducted using appliances or apparatuses with fluororesin-coated or chrome plated surfaces in direct contact with a raw material or the like.

After a rotary blade of a band saw type slicer was grounded and washed with a ultrapure water (resistivity of 12 MΩ·cm or higher), the produced polyurethane foam block was sliced with the band saw type slicer to thereby obtain a polyurethane foam sheet. Then, a buffing machine with a polishing belt on which silicon carbide powder as abrasive grains is provided (manufactured by RIKEN CORUNDUM CO. LTD.) was used and the sheet was surface buffed to a predetermined thickness to thereby obtain the sheet with an adjusted thickness precision. The buff treated polyurethane foam sheet (a thickness of 1.27 mm) was punched to obtain a disc with a predetermined diameter and concentric circular grooves with a groove width of 0.25 mm, a groove pitch of 1.50 mm and a groove depth of 0.40 mm were recessed on the disc with a recessing machine.

A double sided tape (double tack tape, manufactured by Sekisui Chemical Co., Ltd.) was adhered onto a surface on the other side of the sheet from a recessed surface thereof with a laminator and thereafter, an aperture (with a size of 57 mm×20 mm) for fittingly inserting a light-transmitting region at a predetermined position on the recessed sheet was punched to thereby fabricate a polishing region attached with a double sided tape. The fabricated polishing region had physical properties of an average bubble diameter of 45 μm, a specific gravity of 0.86, an Asker hardness D of 53 degrees.

(Manufacture of Polishing Pad)

A cushion layer made of a corona-treated polyethylene foam (TORAYPEF with a thickness of 0.8 mm, manufactured by TORAY INDUSTRIES, INC.) and a surface of which was buffed was adhered onto a pressure sensitive adhesive surface of a fabricated polishing region attached with a double sided tape with a laminator. Then a double sided tape was adhered onto a surface of the cushion layer. The cushion layer was punched so as to form a hole with a size of 51 mm×14 mm within a hole punched in order to fittingly insert a light-transmitting region. Then a fabricated light-transmitting region was fittingly inserted into the aperture to thereby manufacture a polishing pad.

Comparative Example 1

A polishing pad was manufactured by means of a similar method to that in Example 1 with the exception that, in Example 1, a mold having a non-chrome plated surface therein was employed while fabrication of a light-transmitting region.

(Measurement of Concentration of Contained Metals)

A fabricated polyurethane foam for a polishing region and a fabricated polyurethane for a light-transmitting region were carbonized and ashed (550° C.) and thereafter, residues were dissolved into 1.2 N hydrochloric acid solution to thereby obtain test liquids. Elements in a test liquid was measured by means of ICP emission spectroscopic analysis method (CIROS-120, manufactured by RIGAKU CORPORATION). In Table 5, there are shown results of measurement.

Measurement emission beams for ICP emission spectroscopic analysis were: 259.940 nm for Fe, 231.604 nm for Ni, 324.754 nm for Cu, 213.856 nm for Zn and 396.152 nm for Al.

(Evaluation of Oxide Film Withstand Voltage)

An n-type CZ Si wafer with a surface orientation of (100) and a resistivity of 10 Ωcm was polished on a manufactured polishing pad. A polishing apparatus SPP600S (manufactured by Okamoto Machine Tool Works, Ltd.) was employed. A polishing condition included addition of a silica slurry as a slurry (SS-12, manufactured by Cabot Microelectronics Corporation) at a flow rate of 150 ml/min during polishing. Other polishing conditions were such that a polishing load was 350 g/cm$^2$, a rotation number of a polishing platen was 35 rpm, a wafer rotation number was 30 rpm. A polishing time was set to 2 min The wafer after polishing was subjected to RCA cleaning and to cleaning using a 5% dilute HF for removing a chemical oxide film formed during the cleaning. Thereafter, the wafer was dry oxidized at 900° C. for 2 hr. An oxide film thickness at this time was about 300 Å. An Al electrode MOS capacitor was fabricated on the wafer and an electrode with a diameter of 5 mmϕ was further fabricated thereon. Then, the rear surface of the wafer was sandblasted and vapor deposited with gold which was used as a rear surface electrode. A ramp voltage was applied to the 5 mm+diameter electrode with polarities that the Al electrode was (+) and the rear surface electrode (−).

A capacitor was determined good that a voltage applied to the oxide film was 7.5 MV or high when a leakage current density of the oxide film was 1 μA/cm$^2$. One hundred wafers were polished and a non-defected percentage was obtained from a proportion of good capacitors relative to all capacitors in test. In Table 5, there are shown non-defected percentages of the test pieces.

TABLE 5

| | Concentration of contained metals (ppm) | | | | | | | | | | |
|---|---|---|---|---|---|---|---|---|---|---|---|
| | Polishing region | | | | | Light-transmitting region | | | | | Yield |
| | Fe | Ni | Cu | Zn | Al | Fe | Ni | Cu | Zn | Al | (%) |
| Example 1 | 0.26 | 0.08 | 0.45 | 0.08 | 1.15 | 0.25 | 0.05 | 0.04 | 0.06 | 1.12 | 86 |
| Comparative Example 1 | 0.27 | 0.07 | 0.44 | 0.09 | 1.17 | 0.54 | 1.53 | 0.68 | 0.35 | 2.51 | 40 |

As is clear from the results shown above, by polishing a wafer using a polishing pad made of a polymer with a concentrations of specific metals lower than respective corresponding threshold values, metal contamination on a wafer after polishing was reduced, which makes it possible to drastically improve a product yield of a semiconductor device.

The invention claimed is:

1. A polishing pad having a polishing region and a light-transmitting region, wherein a water permeation preventive layer is provided on one surface of the polishing region and the light-transmitting region, and the light-transmitting region and the water permeation preventive layer are made of the same material integrally in a single piece, wherein each of the polishing region and the light-transmitting region comprise a polymer made from raw materials on equipment that comprises surfaces contacting said raw materials, wherein said surfaces comprise no metal other than chrome such that each of said regions have a concentration of Fe of 0.3 ppm or less, a concentration of Ni of 1.0 ppm or less, a concentration of copper of 0.5 ppm or less, a concentration of zinc of 0.1 ppm or less and a concentration of Al of 1.2 ppm or less.

2. The polishing pad according to claim 1, wherein no interface exists between the light-transmitting region and the water permeation preventive layer.

3. The polishing pad according to claim 1, wherein the water permeation preventive layer has a cushioning property.

4. The polishing pad according to claim 1, wherein a material of which the light-transmitting region and the water permeation preventive layer are made is a non-foam.

5. The polishing pad according to claim 1, wherein a material of which the polishing region is made is a fine foam.

6. The polishing pad according to claim 1, wherein the light-transmitting region has no depression and protrusion structure for holding or renewing a polishing liquid on a polishing side surface thereof.

7. The polishing pad according to claim 1, wherein the polishing region has a depression and protrusion structure for holding or renewing a polishing liquid on a polishing side surface thereof.

8. A method for manufacturing the polishing pad according to claim 1, comprising: a step of forming an aperture for providing the light-transmitting region in the polishing region; a step of casting a material into a mold having shapes of the light-transmitting region and the water permeation preventive layer and curing the material to thereby form a transparent member into which the light-transmitting region and the water permeation preventive layer are made integrally as a single piece; and a step of fittingly inserting the light-transmitting region into the aperture in the polishing region to thereby laminate the polishing region and the transparent member.

9. A method for manufacturing the polishing pad according to claim 1, comprising: a step of forming an aperture for providing the light-transmitting region in the polishing region; and a step of casting a material into a space section having shapes of the aperture and the water permeation preventive layer and curing the material to thereby form a transparent member into which the light-transmitting region and the water permeation preventive layer are made integrally as a single piece.

10. A method for manufacturing a semiconductor device comprising steps of polishing a surface of a semiconductor wafer using a polishing pad according to claim 1.

11. A polishing pad having a polishing region and a light-transmitting region according to claim 1, wherein a compressibility of the light-transmitting region is more than a compressibility of the polishing region.

12. The polishing pad according to claim 11, wherein a compressibility of the light-transmitting region is in the range of from 1.5 to 10%.

13. The polishing pad according to claim 11, wherein a compressibility of the polishing region is in the range of from 0.5 to 5%.

14. The polishing pad according to claim 11, wherein the light-transmitting region has a light transmittance of 80% or more at a wavelength in all the region of from 500 to 700 nm in wavelength.

15. A method for manufacturing a semiconductor device comprising steps of polishing a surface of a semiconductor wafer using a polishing pad according to claim 11.

16. A polishing pad, in which a polishing layer having a polishing region and an aperture A for providing a light-transmitting region therein and a cushion layer having an aperture B smaller than the light-transmitting region are laminated one on the other so that the apertures A and B are superimposed one on the other, the light-transmitting region is provided on the aperture B and in the aperture A and a water non-permeable elastic member having a hardness lower than the polishing region and the light-transmitting region is provided in an annular groove existing between the aperture A and the light-transmitting region, wherein the water non-permeable elastic member is made of a water non-permeable resin composition containing a water non-permeable resin of at least one kind selected from the group consisting of a rubber, a thermoplastic elastomer and a reaction curable resin, and wherein the water non-permeable elastic member is lower in height than the annular groove.

17. The polishing pad according to claim 16, wherein the water non-permeable elastic member has an Asker hardness A of 80 degrees or less.

18. A method for manufacturing the polishing pad according to claim 16, comprising: a step of laminating a cushion layer on a polishing layer having a polishing region and an aperture A for providing the light-transmitting region; a step of removing part of the cushion layer in the aperture A to form an aperture B smaller than the light-transmitting region in the cushion layer; a step of providing the light-transmitting region on the aperture B and in the aperture A; and a step of casting a water non-permeable resin composition into an annular groove existing between the aperture A and the light-transmitting region and curing the composition to thereby form a water non-permeable elastic member.

19. A method for manufacturing the polishing pad according to claim 16, comprising: a step of laminating a polishing layer having a polishing region and an aperture A for providing the light-transmitting region and a cushion layer having an aperture B smaller than the light-transmitting region one on the other so that the apertures A and B are superimposed one on the other; a step of providing the light-transmitting region on the aperture B and in the aperture A; and a step of casting a water non-permeable resin composition into an annular groove existing between the aperture A and the light-transmitting region and curing the composition to thereby form a water non-permeable elastic member.

20. A method for manufacturing a semiconductor device comprising steps of polishing a surface of a semiconductor wafer using a polishing pad according to claim 16.

21. A polishing pad in which a polishing layer having a polishing region and a light-transmitting region and a cushion layer having an aperture B smaller than the light-transmitting region are laminated one on the other so that the light-transmitting region and the aperture B are superimposed one on the other and an annular water non-permeable elastic member is provided over a contact portion between the rear surface of the light-transmitting region and a section of the aperture B so as to cover the contact portion, wherein the water non-permeable elastic member is made of a water non-permeable resin composition containing a water non-permeable resin of at least one kind selected from the group consisting of a rubber, a thermoplastic elastomer and a reaction curable resin.

22. The polishing pad according to claim 21, wherein the water non-permeable elastic member has an Asker hardness A of 80 degrees or less.

23. A method for manufacturing the polishing pad according to claim 21, comprising: a step of laminating a polishing layer having a polishing region and a light-transmitting region and a cushion layer having an aperture B smaller than the light-transmitting region one on the other so that the light-transmitting region and the aperture B are superimposed one on the other; and a step of coating a water non-permeable resin composition over a contact portion between the rear surface of the light-transmitting region and a section of the aperture B to cure the wet coat and to thereby form an annular water non-permeable elastic member so as to cover the contact portion.

24. A method for manufacturing the polishing pad according to claim 21, comprising: a step of laminating a cushion layer on a polishing layer having a polishing region and an aperture A for providing the light-transmitting region so as to be inserted therein; a step of removing part of the cushion layer in the aperture A to form an aperture B smaller than the light-transmitting region in the cushion layer; a step of providing the light-transmitting region on the aperture B and in the aperture A; and a step of coating a water non-permeable resin composition over a contact portion between the rear surface of the light-transmitting region and a section of the aperture B to cure the wet coat and to thereby form an annular water non-permeable elastic member so as to cover the contact portion.

25. A method for manufacturing the polishing pad according to claim 21, comprising: a step of laminating a polishing layer having a polishing region and an aperture A for providing the light-transmitting region so as to be inserted therein and a cushion layer having the aperture B smaller than the light-transmitting region one on the other so that the apertures A and B are superimposed one on the other; a step of providing the light-transmitting region on the aperture B and in the aperture A; and a step of coating a water non-permeable resin composition over a contact portion between the rear surface of the light-transmitting region and a section of the aperture B to cure the wet coat and to thereby form an annular water non-permeable elastic member so as to cover the contact portion.

26. A method for manufacturing a semiconductor device comprising steps of polishing a surface of a semiconductor wafer using a polishing pad according to claim 21.

27. A polishing pad having a polishing region and a light-transmitting region, wherein each of the polishing region and the light-transmitting region comprise a polymer made from raw materials on equipment that comprises surfaces contacting said raw materials, wherein said surfaces comprise no metal other than chrome such that each of said regions have a concentration of Fe of 0.3 ppm or less, a concentration of Ni of 1.0 ppm or less, a concentration of copper of 0.5 ppm or less, a concentration of zinc of 0.1 ppm or less and a concentration of Al of 1.2 ppm or less.

28. The polishing pad according to claim 27, wherein a material of the polishing region and the light-transmitting region is a polymer of at least one kind selected from the group consisting of a polyolefin resin, a polyurethane resin, a (meth)acrylic resin, a silicone resin, a fluororesin, a polyester resin, a polyamide resin, a polyamideimide resin and a photosensitive resin.

29. A method for manufacturing a semiconductor device comprising steps of polishing a surface of a semiconductor wafer using a polishing pad according to claim 27.

* * * * *

UNITED STATES PATENT AND TRADEMARK OFFICE

CERTIFICATE OF CORRECTION

PATENT NO. : 7,871,309 B2
APPLICATION NO. : 11/720964
DATED : January 18, 2011
INVENTOR(S) : Ogawa et al.

It is certified that error appears in the above-identified patent and that said Letters Patent is hereby corrected as shown below:

At column 3, line 67, after "(" insert --.--.

At column 4, line 8, after "(" insert --.--.

At column 17, line 35, change "stylylpyridinium" to --styrylpyridinium--.

At column 17, line 36, change "tymine" to --thymine--.

At column 32, line 44, change "perfluoroalcoxyalkane" to --perfluoroalkoxyalkane--.

At column 37, line 34, change "Toyobouseki" to --Toyoboseki--.

At column 44, line 40, change "polesterpolyol" to --polyesterpolyol--.

At column 48, line 29, change "polesterpolyol" to --polyesterpolyol--.

At column 56, line 36, after "min" insert --.--.

Signed and Sealed this
Twentieth Day of December, 2011

David J. Kappos

David J. Kappos
*Director of the United States Patent and Trademark Office*